United States Patent [19]

Bihler

[11] Patent Number: 4,684,203

[45] Date of Patent: Aug. 4, 1987

[54] SMALL-SIZED CONTACT PIN PACKAGE

[76] Inventor: Otto Bihler, Schleiferweg 2, D-8959 Halblech, Fed. Rep. of Germany

[21] Appl. No.: 825,688

[22] Filed: Jan. 31, 1986

Related U.S. Application Data

[63] Continuation of Ser. No. 513,026, Jul. 12, 1983, abandoned.

[30] Foreign Application Priority Data

Jul. 30, 1982 [DE] Fed. Rep. of Germany ..... 3228581
Jan. 28, 1983 [EP] European Pat. Off. ..... 83100831.3

[51] Int. Cl.[4] ..... H01R 13/42; H01R 9/09

[52] U.S. Cl. ..... 439/751; 29/876; 29/879; 29/884; 439/82; 439/885

[58] Field of Search ..... 339/17 C, 220 R, 221 R, 339/221 M, 252 R, 252 P, 262 R, 276 SF, 278 C, 18 P; 29/876, 878, 879, 882, 884

[56] References Cited

U.S. PATENT DOCUMENTS

| | | | |
|---|---|---|---|
| 2,390,706 | 12/1945 | Hearon | 339/252 P |
| 2,914,745 | 11/1959 | Krol et al. | 339/220 R |
| 3,268,851 | 8/1966 | Mancini | 339/221 R |
| 3,560,911 | 2/1971 | Zimmerman, Jr. et al. | 339/278 C |
| 3,665,378 | 5/1972 | Hammell et al. | 339/262 R |
| 3,766,516 | 10/1973 | Appleton | 339/252 P |
| 3,782,412 | 2/1974 | Madden | 339/17 C |
| 3,824,554 | 7/1974 | Shoholm | 339/252 P |
| 3,832,770 | 9/1974 | Gluntz | 29/884 |
| 3,846,741 | 11/1974 | Kunkle et al. | 339/221 R |
| 3,990,768 | 11/1976 | Faber | 339/262 R |
| 4,037,915 | 7/1977 | Cabaud | 339/26 SF |
| 4,043,893 | 8/1977 | Gelfand | 339/278 C |
| 4,155,321 | 5/1979 | Tamburro | 29/882 |
| 4,223,970 | 9/1980 | Walter | 339/220 R |
| 4,315,365 | 2/1982 | Wigby | 29/884 |
| 4,369,572 | 1/1983 | Atkins | 29/879 |

FOREIGN PATENT DOCUMENTS

| | | | |
|---|---|---|---|
| 1936422 | 7/1969 | Fed. Rep. of Germany . | |
| 2228953 | 1/1974 | Fed. Rep. of Germany . | |
| 3006437 | 2/1980 | Fed. Rep. of Germany . | |
| 3120629 | 12/1982 | Fed. Rep. of Germany . | |
| 607506 | 3/1926 | France | 339/252 P |
| 7531087 | 10/1975 | France . | |
| 218059 | 7/1924 | United Kingdom | 339/252 P |
| 280689 | 11/1927 | United Kingdom | 339/252 P |
| 1109331 | 4/1968 | United Kingdom | 339/276 SF |
| 1178830 | 1/1970 | United Kingdom | 339/252 R |

*Primary Examiner*—Eugene F. Desmond
*Assistant Examiner*—Gary F. Paumen
*Attorney, Agent, or Firm*—Fleit, Jacobson, Cohn & Price

[57] ABSTRACT

In connection with a small-sized contact pin package for engagement with a plug socket of approximately circular cross-section, it is proposed that the contact pin package should comprise a basic pin, whose cross-section is elongate, over at least a partial section of its length, with a long cross-sectional axis, whose length corresponds approximately to the inside diameter of the plug socket, and with a short cross-sectional axis, and that there should be provided, on at least one of the basic pin partial section lateral surfaces which are vertical to the short cross-sectional axis, a contact spring subjected to bending, which spring extends in the longitudinal direction of the basic pin and is supported on this lateral surface and is conductively connected to the basic pin and is dimensioned with the circumference of the plug socket for electric contact engagement with radial tension.

116 Claims, 31 Drawing Figures

12
10
28b
20
28
20
III
14
16
18

12
B
10
A
32
24
34
C
30a
30
26
28b
28b
28c
28
28a
20
20

114
B
A
126
C
126

B
D
A
C 319
320k
XXIV
319
320k
323a
320g
323
323a
XXIV
311
319
307
311
317
315
315
313
309
315
313
315
320g
309
319
319
320l
319
320l

SMALL-SIZED CONTACT PIN PACKAGE

This application is a continuation of application Ser. No. 513,026, filed July 12, 1983, now abandoned.

BACKGROUND TO THE INVENTION

The invention relates to a small-sized contact pin package for engagement with a plug socket of approximately circular cross-section.

The small-sized contact pin package discussed herein concerns, in particular, sizes corresponding to an inside diameter of the plug socket of up to 2.5 mm, more especially approximately 1 mm. The contact pin package is intended, in particular, for connecting chips or IC modules electrically and, if necessary, also mechanically on printed-circuit boards. In this case, the plug sockets are formed by metallised, more especially tin-coated, holes in the printed-circuit boards. It is usual to insert the contact pins into such tin-coated holes and then to solder them to the rear, i.e. the side of the printed-circuit board that is remote from the chip. In addition thereto, it has also been attempted simply to insert the contact pins into the metallised holes and to establish the electrically conductive connection without any subsequent soldering. However, this entails the difficulty that the diameters of these metallised holes vary, particularly because of the production methods used for metallisation, so that reliable contact making, for example in the case of over-sized holes, is uncertain. However, since minute voltages may have to be transmitted, it is important that the contacts should be produced with a low voltage drop. In order nevertheless to do without the subsequent soldering of the contact pins, it has been attempted to work the plug pins in such a way that they are elastically deformable and elastically abut the metallisation of the internal circumference of the hole. For example, the attempt has been made to split the contact pins over a portion of their length and to joggle the branches formed by the splitting. However, it has turned out that the elasticity coming about in this connection is not sufficient in order to provide reliable contact making. It turned out, in particular, that the friction between the branches, which were still abutting each other after the splitting, impaired the elastic resilience of these branches relative to each other. It was therefore possible, for example in connection with a hole which was undersized due to a deviation from tolerance, that, because of the insufficient elastic resilience, the contact pin worked itself into the metallisation to such an extent that the metallisation was pushed aside and the contact pin abutted the non-metallised internal circumference of the hole, so that the contact-making quality was again jeopardised.

OBJECT OF THE INVENTION

An object of the invention is to design a small-sized contact pin package in such a way that it is automatically adapted to contact bushes which vary in diameter, more especially to metallised holes in printed-circuit boards, and provides, within the tolerance limits of such metallised holes which are to be expected, effective contact making along with a correspondingly low voltage drop, even if there is not effected any subsequent soldering. However, subsequent soldering will not be excluded.

SUMMARY OF THE INVENTION

To solve this problem, it is proposed according to the invention that the contact pin package should comprise a basic pin whose cross-section is elongate over at least a partial section of its length, with a long cross-sectional axis, whose length corresponds approximately to the inside diameter of the plug socket, and with a shorter cross-sectional axis, and that there should be arranged, at least on one of the lateral surfaces, which are perpendicular to the short cross-sectional axis, of the partial section of the basic pin, a contact spring subjected to bending stress and extending in the longitudinal direction of the basic pin and which is supported on this lateral surface and is conductively connected with the basic pin and is dimensioned with respect to the inside circumference of the plug socket so as to make electric contact with the socket along with radial pressure thereon.

The boldness of venturing to attach a contact spring subjected to bending stress to a basic pin becomes clear if one calls to mind that the inside diameter of the plug socket, for example a metallised hole in a printed-circuit board, is of the order of 1 mm, for example approximately 1.143 mm or 0.889 mm; both are standard sizes in the technique of connecting chips or the like to printed-circuit boards.

In the design according to the invention, centering can be effected in the direction of the long cross-sectional axis, due to the partial section of elongate cross-section, while the contact spring subjected to bending, or preferably two contact springs subjected to bending, abuts or abut elastically the internal circumference of the plug socket and brings about or bring about effective electric contact making. The long axis of the elongate cross-section is co-ordinated with a mean diameter of the plug socket, so that the partial section lateral surfaces which are perpendicular to the short cross-sectional axis, with the minimum inside diameters of the plug sockets, possibly penetrate into the metal thereof and, with the maximum inside diameters, are in any event opposite to the inside circumference of the metallisation at such a short distance that a centring is ensured in any event. With plug sockets of small inside diameters, this may lead to the metallisation being pushed aside and the contact pin, with its lateral surfaces which are perpendicular to the short cross-sectional axis of the elongate cross-section, butting against the uncoated material of the printed-circuit board.

If the inside diameter of the sockets or metallised holes is large, it may be that there is no contact at all or a very poor contact at this point. However, this is no disadvantage because, on account of its elasticity, the contact spring subjected to bending comes to butt in any event against the internal circumference of the socket or the metallised hole, irrespective of whether the hole is at the lower or upper limit of the tolerance band. Therefore, even if the inside diameter of the plug socket is large, adequate contact is made; on the other hand, with diameters at the lower limit of the tolerance band, there is no risk of the material of a metallised hole being pushed aside by the contact springs subjected to bending.

It may even be possible to serve plug sockets, more especially internally tin-coated holes of printed-circuit boards, of different nominal diameters, for example of 1.143 mm and 0.889 mm, with contact pin packages which are designed according to the invention.

Important further features of the invention are set forth below.

The invention involves designing the contact springs subjected to bending in such a way that their surface pressure in relation to the internal circumference of the plug socket is sufficient, on the one hand, so as to bring about an effective electric contact but, on the other hand, does not become excessive, which might result in the metallisation being displaced.

The invention provides contact springs which are of curved construction so as to prevent damage to the metallisation of the plug sockets with the contact springs.

The invention also provides curved contact springs for the purpose of bringing about a considerable elastic resilience of the contact springs subjected to bending, on the one hand; on the other hand, the curved contact springs insure that when the contact pin package is inserted into the plug socket, the contact pressure rises progressively until the end position is reached, which again results in preventing damage to the metallisation of the plug socket.

According to a feature of the invention, an adequate contact pressure is ensured, in particular, if, at least after the plug and socket connection has been established, the two arc ends are supported in the radial direction on the partial section of the basic pin, in spite of the extremely small wall thickness of the leaf springs, which may be of the order of 5 hundredth to 20 hundredth of a millimeter.

Another feature of the invention involves mounting the contact springs on the basic pin with one end of each contact spring longitudinally displaceable so as to permit unobstructed deformation of the contact spring subjected to bending stress, while it is simultaneously radially supported at both ends and while the contact spring is simultaneously located in position on the basic pin.

In addition, the provision of a stop for the longitudinally displaceable end of each contact spring makes it possible to increase, as required, the effective spring hardness of the contact spring subjected to bending stress, at least in the end zone in which the contact pin package approaches the final contact position, there being no need of reinforcing the material of the contact spring for this purpose.

A solution which is particularly favourable from the production point of view—again bear in mind the above-mentioned proportions—involves producing two integrally connected contact springs; the advantage thereof is, on the one hand, that if a contact pin package is provided with two contact springs subjected to bending stress one does not have to handle and fit individually to the basic pin two individual contact springs. Another far-reaching advantage is the fact that the connecting part allows, if necessary, the contact spring to be pre-fixed on the basic pin before they are later welded or soldered together, if necessary, in order to bring about a better transition resistance. The construction of the integrally connected contact springs serves, in particular, for the pre-fixing purpose, and in this context it is pointed out that even if only a single contact spring is used, the U-shaped connecting part may be of advantage with respect to pre-fixing.

Another feature of the integrally connected contact springs is directed, in particular, at keeping the outer contour of the finally assembled connecting part within the inside diameter of the plug socket.

The integrally connected contact springs may be secured to the basic pin in a manner so as to provide a minimal transition resistance between the basic pin and the contact spring subjected to bending stress.

The lateral faces of the basic pin may be convexly rounded to provide a snug adhesion of the partial section to the internal circumference of the plug socket; on the one hand, with a view to a centring that is as exact as possible and, on the other hand, with a view to treating the internal circumference of the plug socket as carefully as possible.

The lateral faces of the basic pin may converge for the purpose of reducing the mechanical slide-in resistance as the contact pin package is inserted into the plug socket and, in the event of a plurality of plugs being provided on a chip, bringing about self-centring of the plug pins relative to one another.

According to one aspect of the invention, a relatively simple process measure makes it possible to obtain from a wire material that is available in the trade the elongate cross-section of the basic pin in the partial section, the curvature of the partial section lateral surfaces which are vertical to the long diameter automatically coming about during the flattening thereof, as a result of pressing; however, this may be promoted by counter-dies. Basically, one can start out from round pieces of wire, but one preferably starts out from pieces of wire of square cross-section, which allows the orientation of the contact pin package about its axis on a pin carrier to be facilitated if, for example, it is desired to fit a plurality of contact pin packages to a pin carrier in a specific orientation.

According to a feature of the invention, the stop for one displaceable end of the contact spring subjected to bending stress comes about during the production of the flattened partial section.

The partial section of the basic pin may have at at least one end, a flattened transition section of a construction which is abutted by the connecting part of the integrally formed contact springs again serves the purpose of keeping the connecting part within the contour of the plug socket.

According to another feature of the invention, a transition shoulder between the flattened section and the undeformed section of the wire from which the basic pin is formed, simultaneously provides an edge for fixing the U-shaped connecting part of the integrally formed contact springs in the longitudinal direction of the basic pin.

Surprisingly, it has been found that, despite the extreme smallness of its dimensions, a contact pin package according to the invention can be produced in a rapid sequence of operations on an automatic stamping and bending machine, this machine allowing the flattening of the wire pieces, the application of the contact springs subjected to bending stress and the welding of the contact springs to the basic pin to be successively effected.

The curvature of the contact spring in the plane vertically to the longitudinal direction of the basic pin is essential for the spring action. It has been found that provision of contact springs having longitudinal edge zones which engage the lateral surfaces makes it possible to obtain maximum elastic pressure forces in the contact springs, and this approximately to an equal extent over approximately the entire length of the contact springs subjected to bending stress.

In another aspect of the invention, in which the contact spring has a bath-tub configuration, the spring force is further increased because in this constructional form the end curvatures of the bath-tub curvature additionally contribute to a stiffening along the lines of attaining increased spring forces. At the same time, the bath-tub end curvatures have the advantage that they promote the trouble-free insertion of the basic pins into plug sockets without any risk of damaging the metallisation thereof.

The providing of end flanges on the bath-tub shaped contact springs ensures an easy method of fastening the contact springs to the associated lateral surfaces of the basic pin.

In accordance with another feature of the invention, the specific curvature construction of the contact springs is such that the spring force available for contact making is further increased.

A specific internal curvature construction of the contact springs ensures that the edges of the contact springs slide on the associated lateral surfaces of the basic pins substantially without digging themselves in when the contact springs are flattened by the insertion of the basic pins into the plug sockets. This dig-in-free sliding is particularly desirable if there is a requirement to allow the basic pin to be inserted, with its contact springs, repeatedly into a plug socket.

If this is the case, it is of course undesirable that the sliding ratios of the longitudinal edges of the contact springs on the associated lateral surfaces of the basic pin should be changed by the digging-in thereof, and an internal curved surface of each contact spring adjacent each longitudinal edge prevents such digging-in.

Another feature of the invention involves making the lateral surfaces plane or roof-shaped surfaces such that, particularly if the lateral surface is designed as a roof surface, the digging-in is additionally prevented.

A further feature of the invention involves the contact springs abutting the lateral surfaces with sharp edges, this being applied, in particular, if one concentrates on a maximum spring force because the spring force which is then available will be further increased by the unfavourable sliding ratios on the basic pin lateral surface which abuts the edges of the contact spring subjected to bending stress.

The spring force available for contact making can be further increased by a lateral surface designed as a flat-trough surface.

In accordance with another feature of the invention, the contact spring has an external curved surface of a construction which proves to be favourable not only in so far as the production is concerned but also because, as the curvature of the contact spring is flattened by the introduction of the basic pin into a plug socket, a surface that is parallel to the short cross-sectional axis is optimally adapted to the circular contour of the plug socket.

Another feature of the invention involves circumferentially stressing or stretching the material of the contact spring during curve shaping, which proves to be particularly advantageous with a view to bringing about a high elastic contact force. It has been found that the available spring force can be greatly increased by the stretch orientation, which is due to a structural change in the material of the contact spring subjected to bending stress.

It has been found that if, in particular, a connecting wire has to be wound helically around the basic pins, great care must be taken, in view of the moments of rotation about the longitudinal axis of the basic pin which occur with winding according to the wire wrap method, that weakenings of the cross-section and notch effects are avoided at the point of transition from the normal cross-section of the basic pin to the flattened cross-section of the basic pin, so that the basic pin can withstand these stresses. Accordingly, the lateral faces of the partial section of the basic pin and other lateral faces of the pin merge in a continuous manner.

The basic pin may be designed, at at least one end, as a plug contact part, namely as a plug contact bush or plug pin.

The contact pin units of the invention may be provided in the form of a magazine strip, which proves to be particularly advantageous with respect to handling, particularly during working, for example during coating of the basic pins and/or the contact springs with precious-metal layers. This measure is also of importance for the installation of a plurality of basic pins into a basic-pin reception carrier.

A particularly favourable solution with respect to the magazine formation involves stamping and bending the contact springs from a sheet metal strip because the sheet-metal material, which is provided anyway for the production of the contact springs, can be simultaneously used for the connection of adjacent basic pins along with the formation of a magazine strip.

The provision of breaking points between the contact springs and portions of the metal strip which connect the basic pins to the strip allows, if necessary, the remnants of the sheet-metal strip to be broken away from the basic pins in a simple manner, for example during or after the installation thereof into a basic-pin reception carrier.

Another feature of the invention involves providing guide means and/or indexing means for easy and exact processing of the magazine strip during the formation of the magazine strip and during the further processing of the magazine strip.

An additional feature of the invention is a magazine strip of special construction such that it becomes possible to prevent the two ends of the basic pins from being overlapped by the carrier strip. This is of particular importance because, when the basic pins are installed by insertion into a basic-pin reception carrier, free access to both ends of the basic pins is required, since one cannot transmit any insertion forces on the basic pins via the extremely weak sheet-metal material, from which the contact springs and the carrier strip are formed.

The presence of two connection strips between the carrier strip and the basic pins is an important advantage for the stiffness of the magazine strip; the stiffness is required with a view to the handling of the magazine strip during its completion and further processing. Nevertheless, it is of course possible, depending on the case of application, to dispense with one connection strip or the other; however, in any event, a connection strip can only be removed when the joining of the contact springs to the basic pin has been completed.

Additional features of the invention are directed to further stiffening of the magazine strip as well as at an easy possibility of breaking the connection strips off at the given point in time.

Another feature of the invention involves stiffening the magazine strip utilizing projecting tabs which define a U-shaped guide section by stiffening the carrier strip, the tabs maintaining however the possibility of rolling the magazine strip up, which may be of use for the storage of the magazine strips between successive working steps or prior to the final application thereof. Furthermore, the U-shaped guide profile facilitates the guidance of the magazine strip through the processing machines used during the production and further processing thereof.

The design according to the invention of the basic pins and the contact springs subjected to bending stress is of special importance for the equipment of multi-layer printed-circuit boards, where there extend between successive layers printed conductors and which are cut by the holes penetrating the printed conductors. For here there exists the situation that the basic pins have to provide a contact force at different levels, depending on which level the respective printed conductor is located. This contact force can be brought about, in particular, independently of the level, with the constructional form of contact springs where the contact force is substantially based on the curvature in a section vertically to the longitudinal direction of the basic pins.

If, for example, ICs or chips are electrically connected to printed-circuit boards, and are also partly mechanically fastened thereto, by means of contact pin packages according to the invention, then this presents the great advantage compared to previously known solutions, where chips were soldered on by their connection bases, that individual chips can be easily exchanged, there being no need to throw the entire printed-circuit board away. The contact pin packages also ensure a vibration-proof mechanical connection.

It is also possible to join combinations of printed-circuit boards with the aid of the contact pin packages according to the invention, for example in such a way that a group of printed-circuit boards is arranged vertically to a superimposed common printed-circtuit board and is connected to this latter. In this case, the basic pins on the printed-circuit boards of the mentioned group would be substantially parallel to these boards and would be introduced, vertically to the superimposed printed-circuit board, into the plug sockets thereof.

The invention further involves a first method for the production of contact pin packages in the form of magazine strips wherein two contact springs with a U-shaped connection piece are placed tranversely to the longitudinal axis of the basic pin, on the pin and then welded thereto. However, it will only be posible to use this method if the mechanical stressing of the basic pins to be expected permits the recesses which are necessary in the basic pins for the attachment of the U-shaped connection pieces, these recesses being necessary so as to ensure that the U-shaped connection pieces will not project beyond the plug socket contour when the insertion into the plug sockets is effected.

The invention further involves a method involving the stretch orientation of the contact springs in the curvature zone to which the following consideration has led:

It is virtually impossible, during the curving of individual contact springs, to introduce into these a stretch orientation along the lines of a desired structural change. One might have in mind to carry out the stretch orientation on the solid-wall sheet-metal plate, from which the contact springs are stamped, prior to stamping. Such a possibility has been taken into consideration within the scope of the invention. However, in this construction, the material would be reduced in thickness in the contact spring zone, due to the stretching action. By previously forming the slots, one has, on the one hand, the stretch orientation under control, due to a corresponding proportioning of the clamping force exerted on the edge zones of the webs, and, on the other hand, the possibility of allowing the edge zones of the webs to slip between the clamping tools, following the curvature, so that there does not occur any undesirable wall thickness reduction of the sheet-metal material in the curvature zone.

In a preferred method for the production of the contact pin packages in the form of magazine strips, the recesses which would be necessary for the above-mentioned reasons in the case of U-shaped connection pieces on the basic pins are not required and one obtains magazine strips on which the basic pins are exposed at both ends so that they can be easily processed further, more especially be introduced in a simple manner with one end into a basic-pin reception carrier, in that appropriate slide-in tools are applied to the respective other end.

BRIEF DESCRIPTION OF DRAWINGS

The invention will now be explained in exemplified embodiments with reference to the accompanying drawings, in which.

DESCRIPTION OF PREFERRRED EMBODIMENTS

Figure 1:
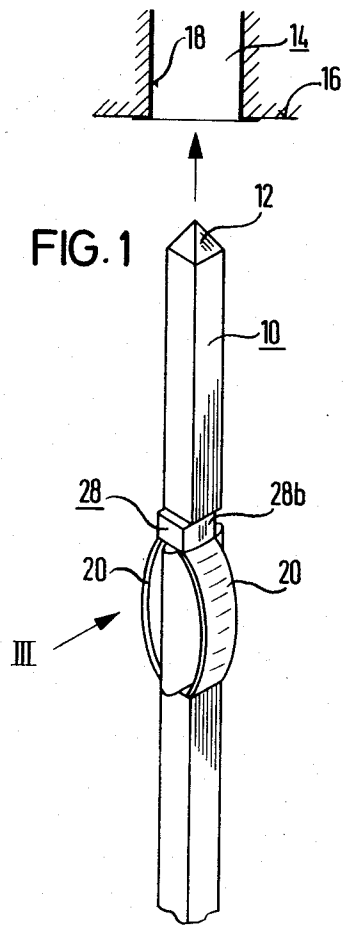
FIG. 1 shows a contact pin package according to the invention, completely assembled, in alignment with a plug socket prior to being inserted into this socket.
Figure 2:
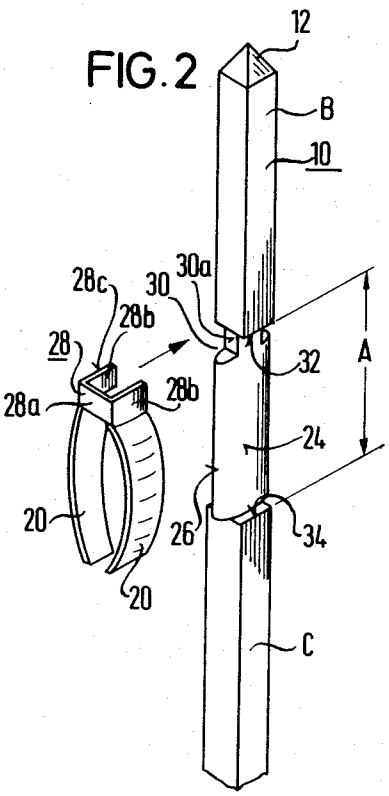
FIG. 2 shows an exploded view of the parts of a contact pin package as shown in FIG. 1, prior to the assembly thereof.

In FIGS. 1 and 2, a basic pin has been designated 10. A tapered end of the basic pin 10 is designated 12.

The basic pin 10 is intended for insertion into a plug socket 14 which is formed, for example, by a hole in a printed-circuit board 16, this hole having been metallised on its internal circumferential surface and and possibly also on the edgings. The metallisation has been designated 18.

Figure 5:
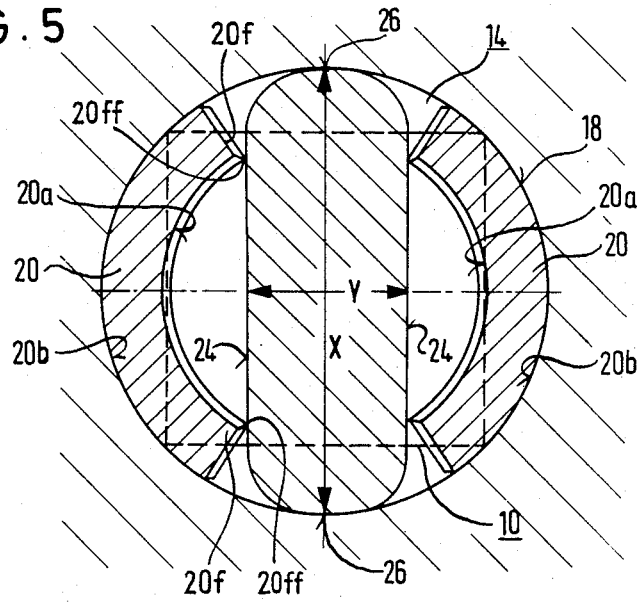
FIG. 5 shows a cross-section along the line V—V of FIG. 3.

The basic pin 10 has a square cross-section. The cross-sectional diagonal corresponds approximately to the diameter of the plug socket 14. Two contact springs 20, which have been subjected to bending stress into an arc-shaped curvature, are provided on the basic pin 10 in the zone of a partial section A of the length of the basic pin 10. As can be seen particularly clearly in FIG. 2, the basic pin 10 has been flattened in the zone of the partial section A. The flattened cross-section can be seen particularly clearly in FIG. 5. As shown in FIG. 5, the flattened elongate cross-section in the partial section A has a long axis X and a short axis Y. The ratio of the length of the long axis X to the length of the short axis Y is approximately 3:1. In the zone of the longitudinal section A, the basic pin 10 comprises two lateral surfaces 24, which are perpendicular to the short axis Y, and two lateral surfaces 26, which are perpendicular to the long axis X. The lateral surfaces 26 are convexly rounded towards the internal circumferential surface of the plug socket 14. As is clearly shown in FIG. 5, long axis X of the elongate cross-section corresponds to the diameter of the plug socket 14 so as to provide centering of the basic pin 10 in the plug socket. The two contact springs 20 are arranged on the lateral surfaces 24. As can be seen in FIG. 5, the leaf springs 20 are curved in cross-section so that their concave lateral surfaces 20*a* are directed towards the lateral surfaces 24 and their convex lateral surfaces 20*b* are directed towards the internal circumferential surface of the plug socket 14.

The axes X and Y of the elongate cross-section of the partial section A coincide and thus are parallel with transverse intersecting central axes of the square cross-section of the basic pin 10, as can be seen in FIG. 5.

The leaf springs 20 are integral with a U-shaped connection part 28 which has a web 28*a* and two legs 28*b*. The legs 28*b* merge downwardly with the leaf springs 20.

The web 28*a* is intended to abut the bottom 30*a* of a notch 30 which is formed in an end section of the partial section A. The legs 28*b* are formed for abutting contact with the lateral surfaces 24.

Figure 4:
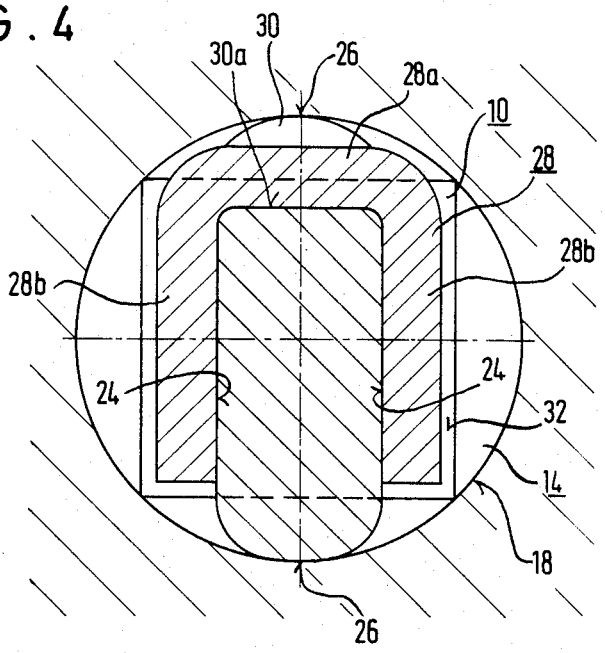
FIG. 4 shows a cross-section along the line IV—IV of FIG. 3.

As can be seen in FIG. 4, the square cross-section of the basic pin 10 rests with its corners approximately on the internal circumference of the plug socket 14. The U-shaped connection piece 28 lies within this internal circumference. At the transition from the partial section A of the basic pin to the upper end section B, there are formed transition shoulders 32, against which the edges 28*c* of the legs 28*b butt. The legs 28b* and/or the web 28*a* are welded together with the basic pin.

Figure 3:
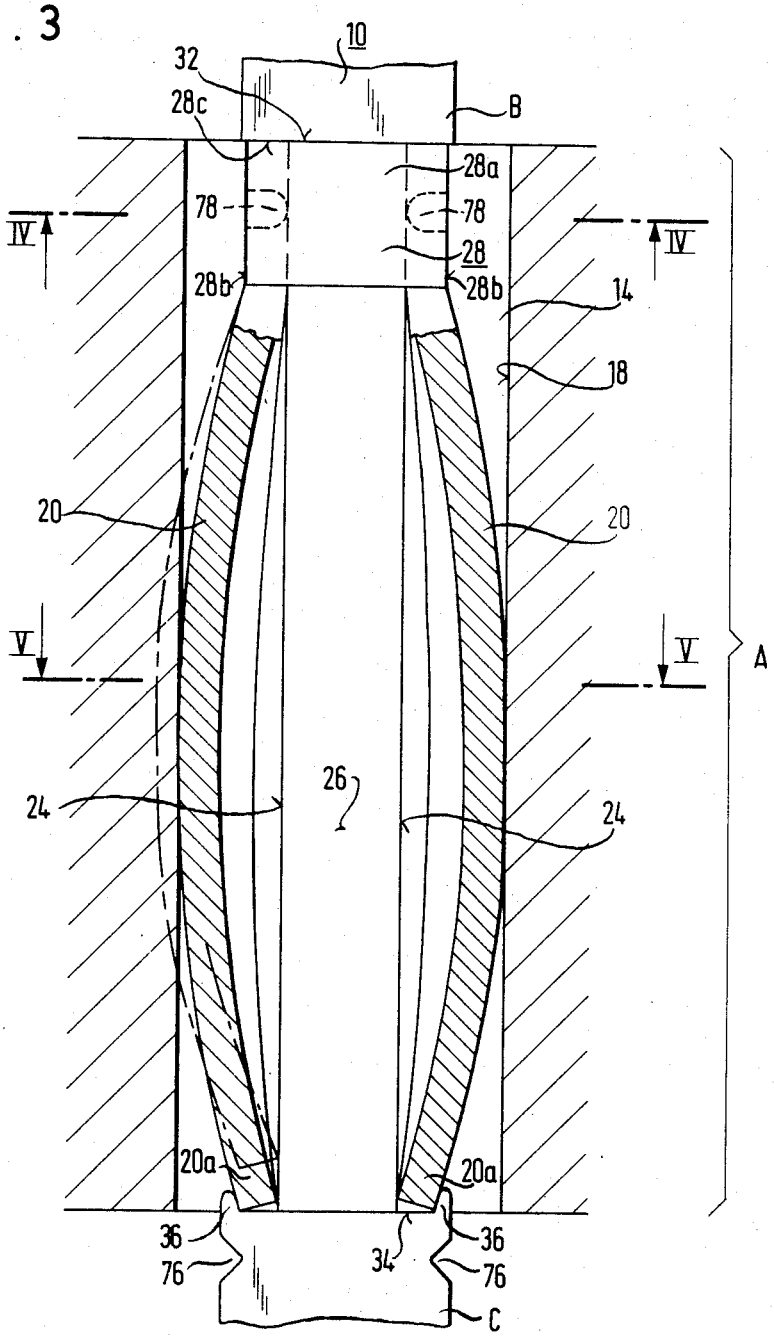
FIG. 3 shows an enlarged lateral view of the contact pin package shown in FIGS. 1 and 2, partly in section (direction of the arrow III in FIG. 1)

In FIG. 3, one discerns the arc-shaped curvature of the leaf springs 20. The lower ends 20*a* of the leaf springs 20 abut the lateral surfaces 24 of the section A. The dash-dotted line in FIG. 3 shows the untensioned shape of a leaf spring 20 prior to the insertion into the plug socket 14. One discerns that, during the insertion, due to the then occurring bending of the elastic leaf springs 20 towards a flat configuration, the springs are displaced inwardly, with their lower ends 20*a* on the lateral surfaces 24, until the lower ends come into abutting contact with stop surfaces 34 of the basic pin 10. The stop surfaces 34 are formed by transition shoulders between the partial section A and the lower partial section C. Adjacent to these stop sufraces 34, there are formed, by way of caulking of the basic pin 10 in the zone of the section C, noses 36, behind which the ends 20*a* of the leaf spring 20 engage, at least when the contact pin package has been fully inserted into the plug socket 14. Due to the ends 20*a* abutting the stop surfaces 34, the resistance of the leaf springs 20 to a radial compression is considerably increased, so that a sufficient contact pressure between the leaf springs 20 and the internal circumferential surface of the plug socket 14 is ensured.

From FIG. 5, one can clearly see that the contact springs 20, which are curved in a cross-sectional area extending perpendicular to the longitudinal axis of the basic pin 10 such as to have their concavely shaped internal faces 20*a* opposed to the lateral surfaces 24, have longitudinal edge zones 20*f,* and more particularly sharp edges 20*ff* of the longitudinal edge zones, which engage the lateral surfaces 24.

Figure 6:
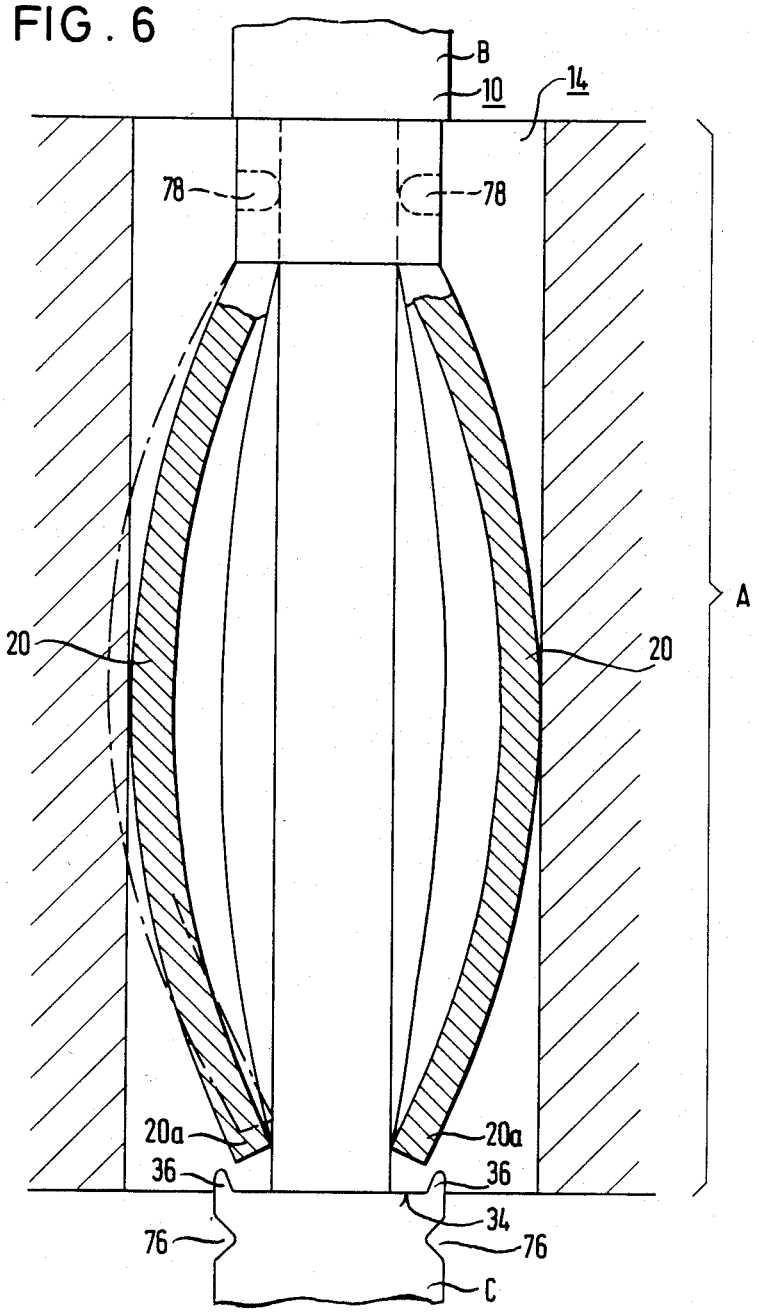
FIG. 6 shows a modified constructional form in respect of FIG. 3, wherein the contact springs subjected to bending stress are tensioned in the axial direction.

As can be seen in FIG. 6, it is however not absolutely necessary that the ends 20*a* of the leaf springs 20 advance as far as the stop surfaces 34 since a sufficient contact pressure can also be ensured by the elastic bending deformation of the leaf springs 20 which have not been clamped axially. In other respects, the constructional form shown in FIG. 6 corresponds to that shown in FIG. 3.

Figure 7:
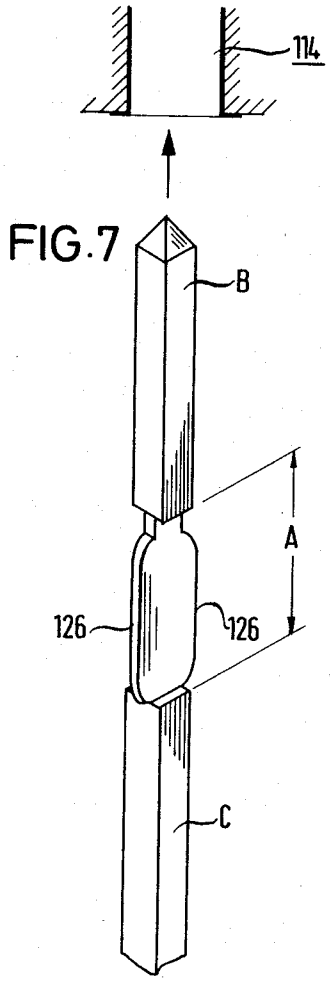
FIG. 7 shows a modification of the basic pin shown in FIG. 2.

The constructional form shown in FIG. 7 differs from the constructional form of the basic pin shown in FIG. 2 in that the lateral surfaces 126 of the partial section A converge, at their upper end (and also at their lower end) in the direction of insertion indicated by the arrow, so that, while being inserted, they can slide smoothly over the edge of the plug socket 114.

Figure 8:
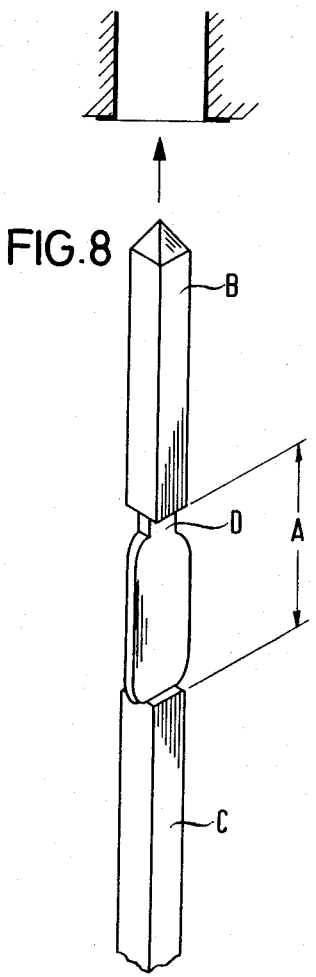
FIG. 8 shows another modification of the basic pin shown in FIG. 2.

Finally, the constructional form shown in FIG. 8 differs from the constructional form shown in FIG. 2 only in that the notch 30 has been dispensed with. In the transition section D, the long axis of the cross-section corresponds to a cross-sectional axis of the square cross-section of the adjoining section B.

In all the cases shown in FIGS. 2, 7 and 8, the partial section A may be formed by flattening between appropriate stamping dies.

The leaf springs 20 may be produced, for example, from Phosphor Bronze metal.

As can be seen in FIG. 3, the length of the partial section A corresponds approximately to treble the inside diameter of the plug socket 14 shown in FIG. 5.

The inside diameter of the plug socket 14 is approximately 1 mm. The wall thickness of the leaf springs 20 is approximately 10/100 mm.

Figure 9:
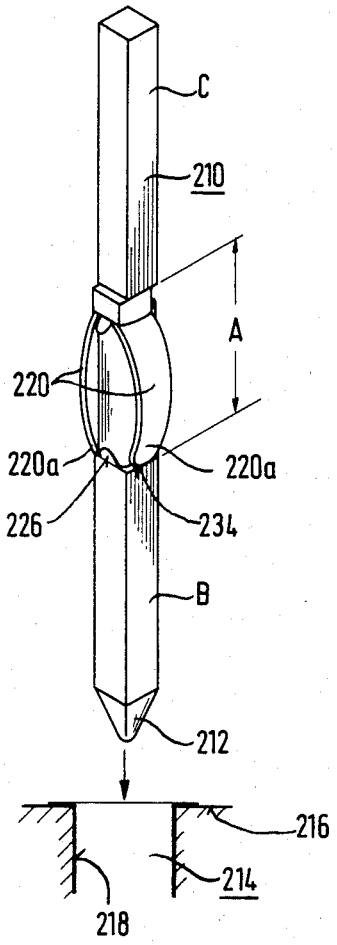
FIG. 9 again shows a modification of the contact pin package.
Figure 10:
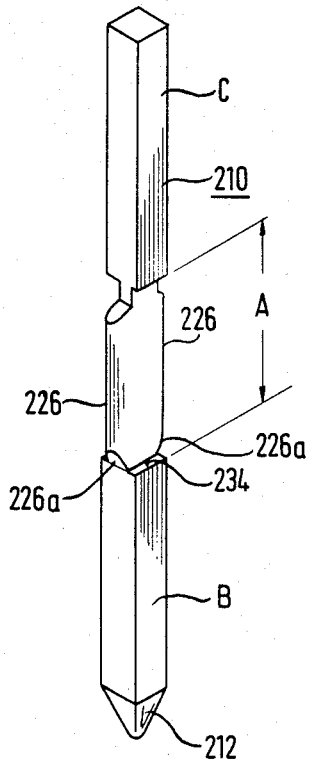
FIG. 10 shows the basic pin in FIG. 9.
Figure 13:
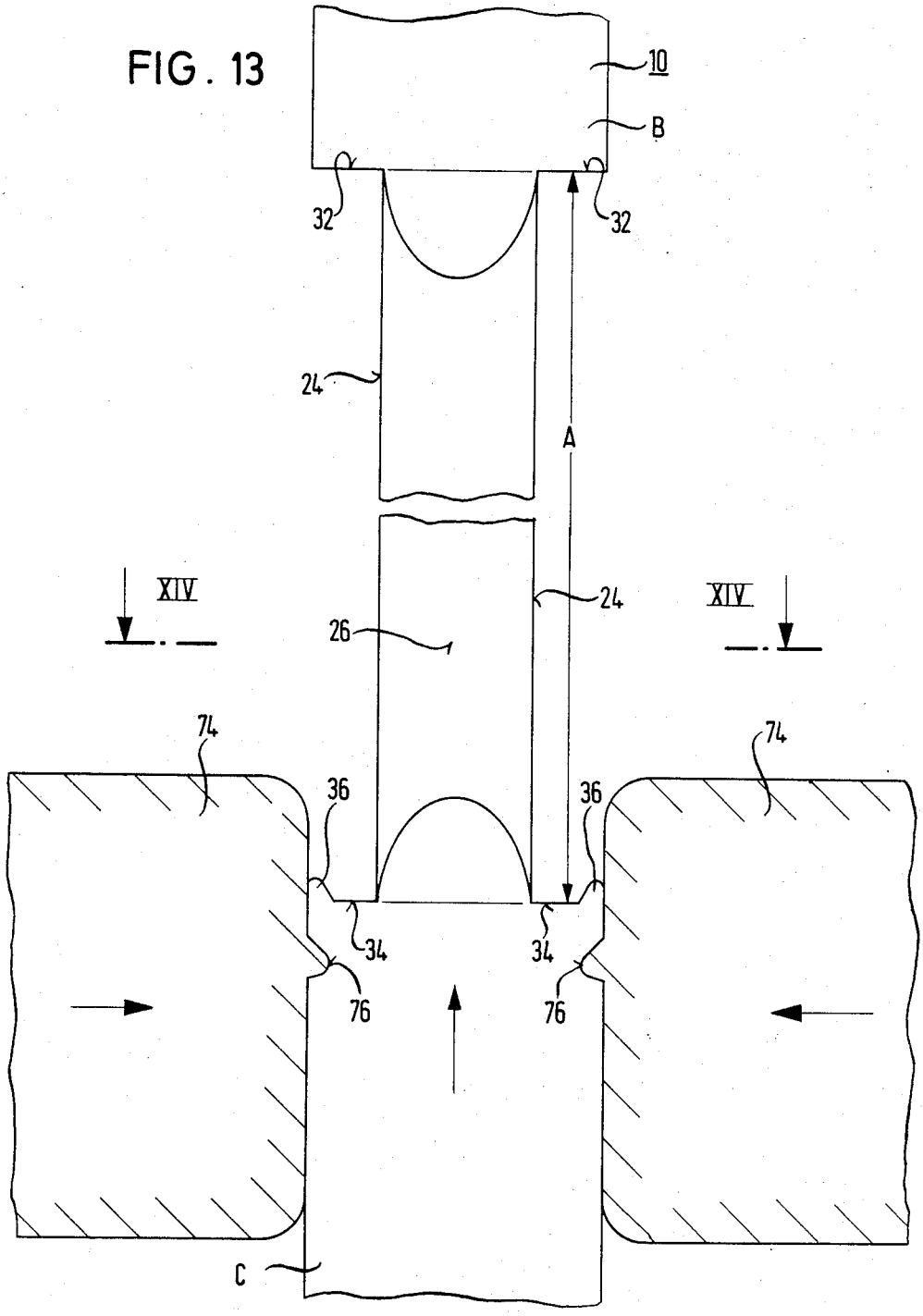
FIG. 13 shows a device for notching the basic pins.

The constructional form shown in FIGS. 9 and 10 differs from that shown in FIGS. 1, 2, 7 and 8 in that the direction of insertion is reversed, that is to say the free ends 220*a* of the leaf springs 220 are introduced first in the direction of insertion. In this constructional form, too, it is possible, with radial pressure exerted on the leaf springs 220, for these to be displaced in the longitudinal direction of the partial section A, namely towards the stop surfaces 234. In order to prevent the leaf spring tips 220*a* from becoming jammed at the inlet to the plug socket 214, the tips 220*a* of the leaf springs 220, which are introduced first in the direction of insertion, are rounded or tapered, as can be seen in FIGS. 9 and 13. The jamming of the first-introduced tips 220*a* is incidentally also prevented in that, similar to FIG. 3, these tips lie behind noses, which are not shown in FIGS. 9 and 10. The lateral surfaces 226 of the partial section A are, at the ends which are inroduced first, beveled in design in the direction of insertion, as indicated at 226*a*, causing the insertion of the contact pin package into the plug socket 214 to be facilitated and preventing it from being jammed at the inlet to the plug socket.

The basic pin 210 preferably consists of brass or bronze. The leaf springs 220 consist of Phosphor Bronze metal or beryllium bronze.

In this constructional form, too, the spring characteristic may be influenced along the lines of a greater spring hardness by the spring tips 220*a* coming into abutting contact with the stop surfaces 234.

Figure 11:
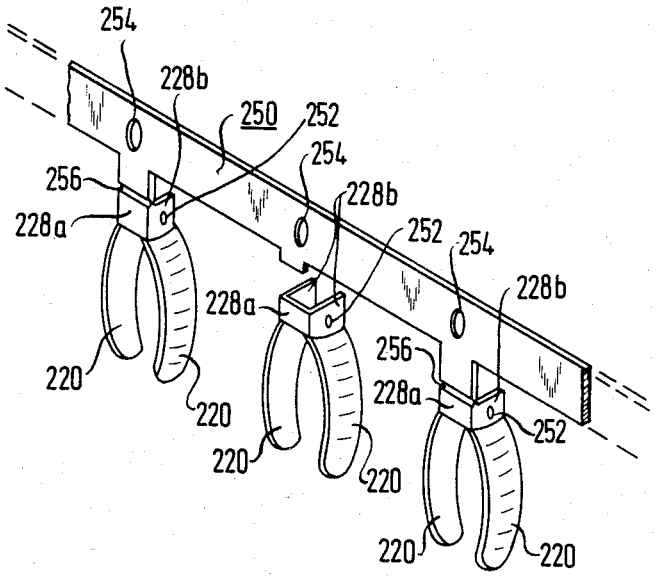
FIG. 11 shows the leaf springs in the state in which they emerge from a bending and stamping machine.

FIG. 11 shows the leaf spring assemblies as they emerge from a stamping and bending machine. One discerns that successive leaf spring assemblies are joined to a connection strip 250; this connection strip 250 is coplanar with the webs 228*a*. The connection strip 250 is the remainder of a metal strip, from which the leaf springs 220 have been stamped. The legs 228*b* and the leaf springs 220 have been brought into the shape shown in FIG. 11 by bending. To the leg 228*b* there have been applied impressions 252 which facilitate the welding of the legs to the basic pin 210 by means of electric transition welding. In the connection strip 250 there are provided transport and/or positioning holes 254 which facilitate the positioning of the individual contact spring assemblies with respect to the associated basic pins in an assembly device. It is possible to perform in a single machine the stamping and bending of the leaf spring assemblies shown in FIG. 11, the shaping of the basic pins 210 shown in FIGS. 9 and 10 and the assembly of the leaf spring assemblies on the basic pins.

In order to allow the leaf spring assemblies to be easily severed from the connection strip 250 in the assembly station, a break line 256 has been pre-formed in the webs 228*a*.

Figure 12:
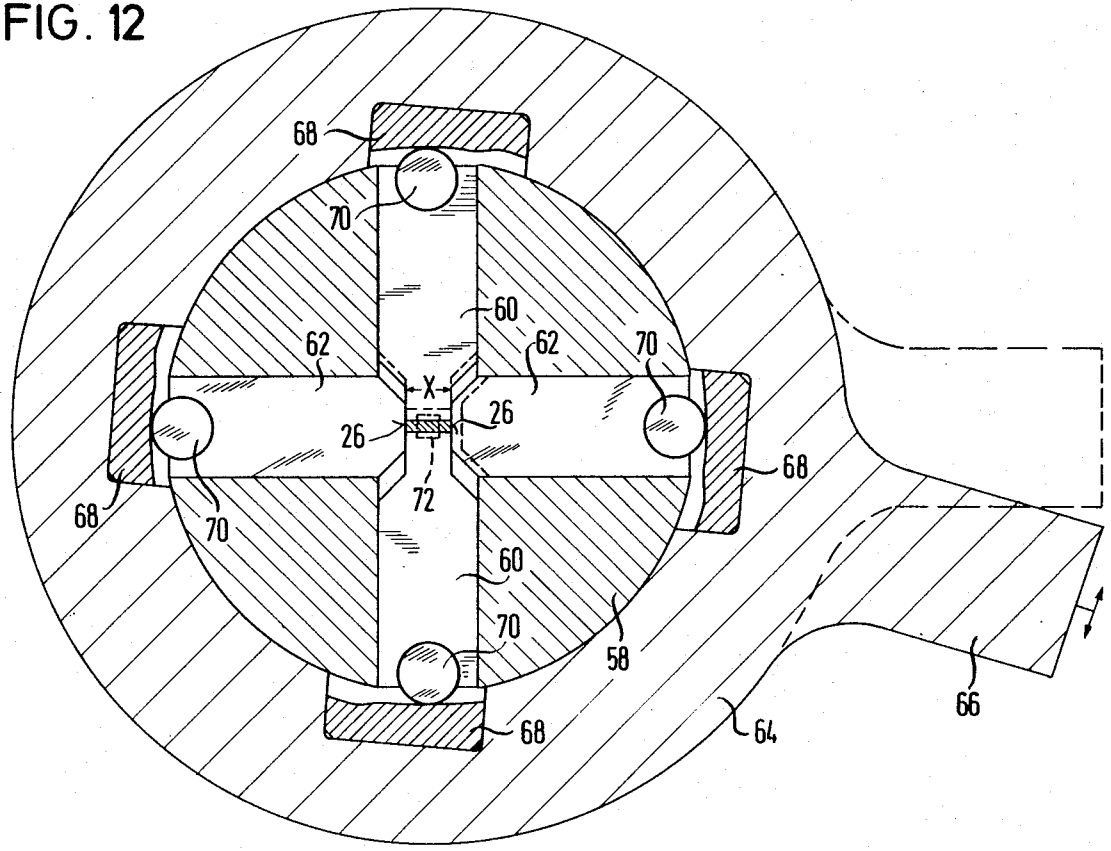
FIG. 12 shows a device for flattening the basic pins.

In FIG. 12, one discerns in section a device for producing the basic pins from a wire of a square cross-section of a lateral length of, for example, 0.62 mm.

In a tool guiding core 58 there are guided, in radial channels, stamping dies 60 and counter support dies 62. For driving these stamping and counter support dies 60 and 62, the tool guiding core 58 is enclosed by a control ring 64, whose driving lever 66 is connected to a driving device. To the internal circumference of the control ring 64 there are fitted control inserts 68 which act on the stamping and counter support dies 60, 62 by means of transmission rollers 70.

A wire 72, which is square in cross-section, is fed vertically to the drawing plane of FIG. 12. As soon as this wire has reached the stamping position, initially the counter support dies 62 are brought from the retracted position shown in broken lines into the counter support position shown in solid lines and in which their distance from each other corresponds to the long axis X of the elongate cross section. Then the stamping dies 60 are advanced from their withdrawn position shown in broken lines until the square cross-section of the wire 72 has been flattened to the elongate cross-section. During this process, the roundness of the lateral surfaces 26 comes about of its own accord. If necessary, the formation of this roundness may be aided by appropriate counter support surfaces on the counter support dies 62.

The stamping and counter support dies may be returned by further cam elements or return springs.

Figure 14:
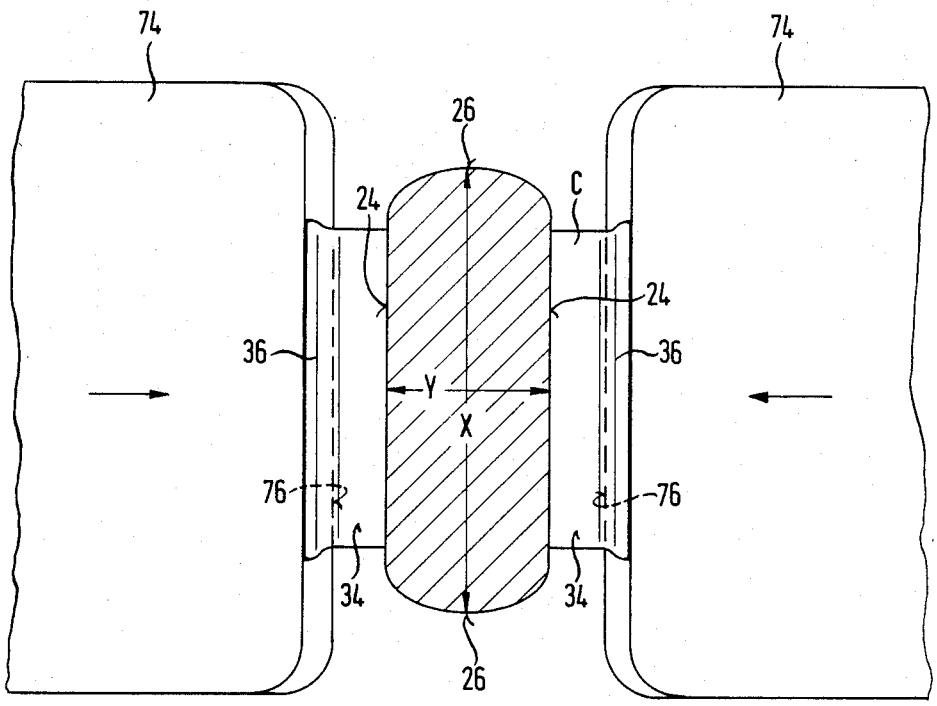
FIG. 14 shows a section along the line XIV—XIV of FIG. 13.

FIGS. 13 and 14 show the operation for the formation of the noses 36 with the aid of notching dies 74. After the formation of the noses 36, there is not only facilitated the introduction of the contact pin package into the plug socket 14 but there is also prevented any lifting of the free leaf spring ends 20*a*; this is of special importance when the contact pin package is so inserted into the plug socket 14 (or 214) such that the free spring ends 20 (or 220) are introduced first.

The notching dies 74 produce the noses 36 by stamping notches 76 into the section C, the material being simultaneously moved upwardly in FIG. 13 along with the formation of the noses 36.

As has been stated, the contact pin packages according to the invention are intended, in particular, for insertion into printed-circuit boards, which mostly consist of epoxy resin. The printed conductors extend on these printed-circuit boards in a specific grid. The connection points of the printed conductors are formed by the internally tin-coated holes which merge, on their edges, with the printed conductors. The contact pin package according to the invention is inserted into these holes.

The mechanical centring by the lateral surfaces 26 at opposite ends of the long axis X of the partial section A ensures the exact fit of associated chips in relation to the printed-circuit boards.

Even if tin is removed by the lateral surfaces 26, the leaf springs 20 establish constant effective contact to the printed-circuit board, even if vibrations occur, the point being that even if the leaf springs are partly plastically deformed while they are inserted, they will still abut the tin-coated internal circumference of the holes 14 in the printed-circuit board with pre-tension. The bevels at 226*a* in FIG. 10 moreover prevent the tin from being stripped from that zone of the tin-coated holes in which the lateral surfaces 226 come into abutting contact, so that in the zone of the lateral surfaces 226*a*, too, a regular electric contact can be expected, although this is basically not necessary in view of the large-surface and elastic contact of the leaf springs 220 with the tin-coated internal circumferential surfaces of the holes.

The production method with the aid of the device shown in FIG. 12 permits a rapid mass production of the basic pins 10. Nevertheless, the required precision is ensured by the exact tool movements; any tool elongation is impossible since all motion cycles occur within the control ring 64. The force transmission via the rollers 70 ensures the elimination of any play.

The strip 250 shown in FIG. 11 facilitates the assembly of the leaf spring assemblies to the basic pins 10.

The welds of the leaf spring assemblies to the partial section A of one of the basic pins 10 are indicated at 78 in FIG. 3.

Figure 15:
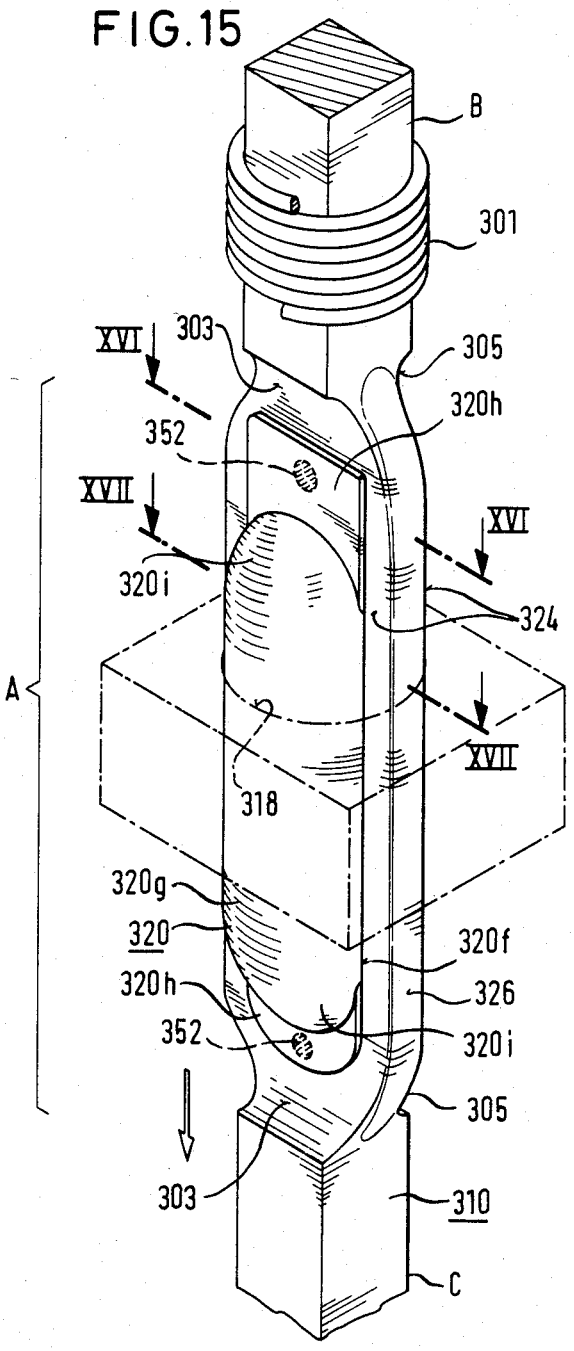
FIG. 15 shows another constructional form of a contact pin package which is particularly suitable for the connection of wires according to the wire-wrap method.
Figure 17:
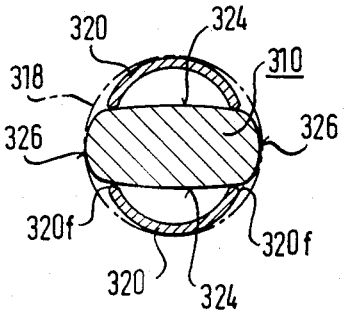
FIG. 17 shows a section along the line XVII—XVII of FIG. 15.
Figure 16:
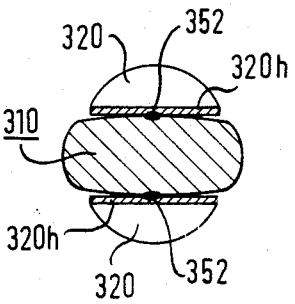
FIG. 16 shows a section along the line XVI—XVI of FIG. 15.

In FIG. 15, there is shown another constructional form of a contact pin package; analogous parts have been provided with the same reference symbols as in the constructional form shown in FIGS. 1 to 6, the number 300 having been added thereto.

In this constructional form, the contact springs 320 which have been subjected to bending into an arc-shaped curvature are designed with a bath-tub-like curvature 320*g*, the longitudinal edge zones 320*f* of which abut the lateral surfaces 324. To the ends of the bath-tub-shaped curvature 320 there have been attached end flanges 320*h* which have been fastened to the lateral surfaces 324 by spot welds 352. The bath-tub-shaped curvatures 320*g* allow large elastic contact forces to be transmitted to the plug socket 318.

It is to be noted that the upper section B of the basic pin has been connected to a wire connection 301 by the wire-wrap method. In view of the torsional forces exerted on the basic pin C during the provision of the wire windings 301, the junctions 303 and 305 of the lateral surfaces 324 and 326 respectively have been made in as stepless a manner as possible.

It is not absolutely necessary to attach the contact springs 320 by welding at both ends. With a view to a length compensation during the compression of the contact springs 320, it is conceivable to provide a spot weld at only one end. As can be readily seen, the end curvatures 320*i* have been made in such a way that they can easily find their way into the plug socket 318. The rounding of the lower end flange 320*h*, too, can promote the introduction into the plug socket 318.

According to FIG. 15, the longitudinal edges 320*f* are substantially over their entire length in engagement with the lateral surfaces 324 of the basic pin 310 when the contact pin unit is inserted into the internal surface 318 as shown in FIG. 15.

Figure 18C:
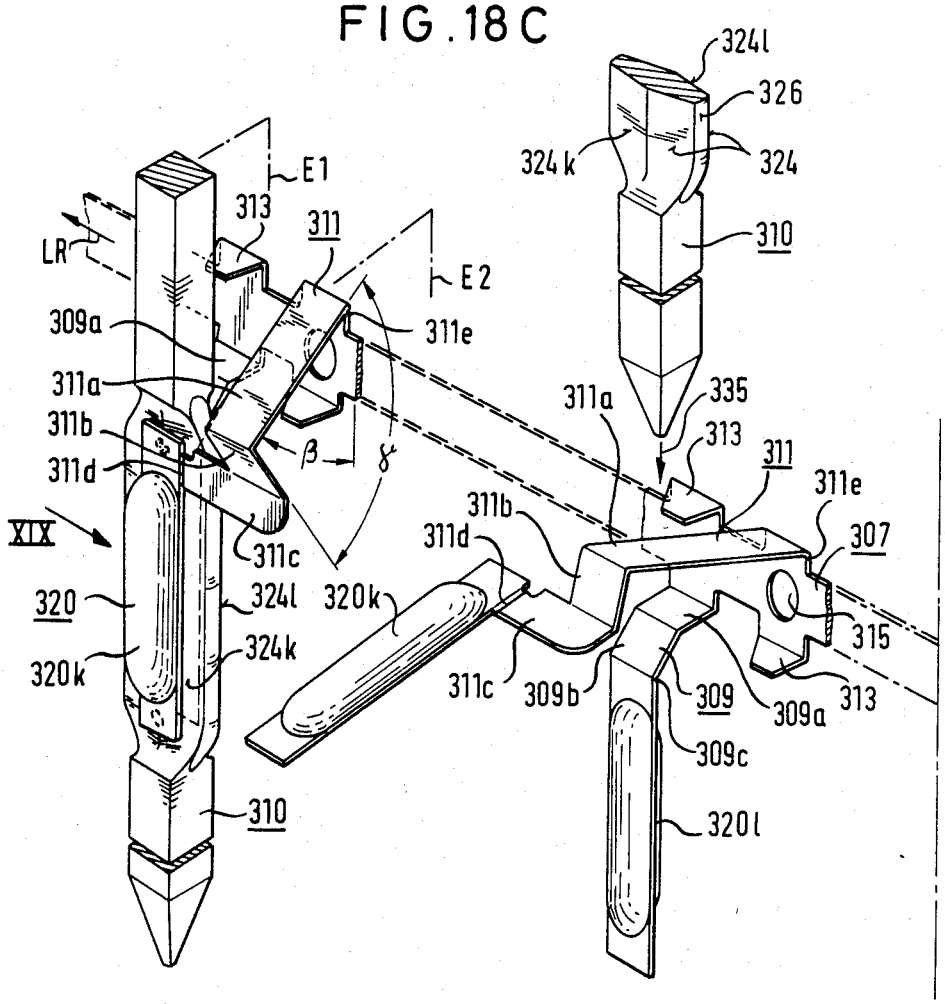
FIGS. 18*a* to 18*c* show different intermediate stages during the production of a contact pin package according to the invention, in the form of a magazine strip made from a sheet-metal strip, for supplying the contact springs and individual basic pins.
Figure 18:
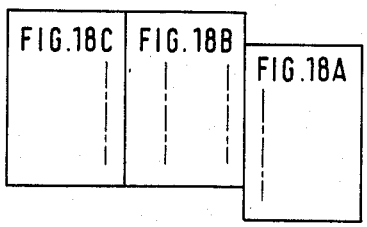

At the left-hand end of FIG. 18*c*, which is a stage in a continuous fabricating diagram shown in FIG. 18, one discerns a contact pin package like that shown in FIG. 15. Two successive basic pins 310 are connected together by a carrier strip 307 in FIG. 18*c*. The carrier strip 307 is integral with the contact springs 320 which have been designated in FIG. 18*c*, 320*k* for the front of the basic pins 310 and 320*l* for the rear thereof; correspondingly, the lateral surfaces 324 of the front of the basic pins have been designated 324*k* and those of the rear have been designated 324*l*. The contact spring 320*l* is connected to the carrier strip 307 via a first connection strip 309 which consists of a first strip section 309*a* and a second strip section 309*b*. The plane of the carrier strip 307 is parallel to the longitudinal axis of the basic pin 310. In the finally bent state, the first strip section 309*a* extends, as shown on the left-hand side in FIG. 18*c*, perpendicularly to the longitudinal direction of the basic pin 310, while the second strip section 309*b* is inclined in relation to the longitudinal direction of the basic pin 310. Between the rear contact spring 320*l* and the second strip section 309*b* there is provided a predetermined breaking point 309*c*. The first connection strip 309 lies in a plane E1 which is parallel to the carrier strip 307.

The front spring 320*k* is connected to the carrier strip 307 by a second connection strip 311. This connection strip 311 consists of a strip section 311*a, b*, which has been angled several times, and a continuation strip 311*c*. The angled strip section 311*a, b* is joined to the carrier strip 307 and lies in a plane E2 which, with respect to the plane E1, is offset in the longitudinal direction of the carrier strip 307 and extends beside the basic pin 310. The continuation strip 311*c* is substantially parallel to the direction LR in which the carrier strip 307 runs and adjoins the angled strip 311*a, b*, on the one hand, and the contact spring 320*k*, on the other hand. Predetermined breaking points are provided at 311*d* and 311*e*. The partial section 311*a* forms an acute angle $\beta$ with the plane of the carrier strip 307. The partial section 311*b* forms an angle $\gamma$ with the partial section 311*a* in the finally bent state, as shown in the left-hand half of FIG. 18*c*. Coming from the carrier strip 307, the partial section 311*a* passes over the lateral surface 324*k* to the front and the partial section 311*b* then returns from the end of the partial section 311*a* to the plane of the lateral surface 324*k*.

Figure 19:
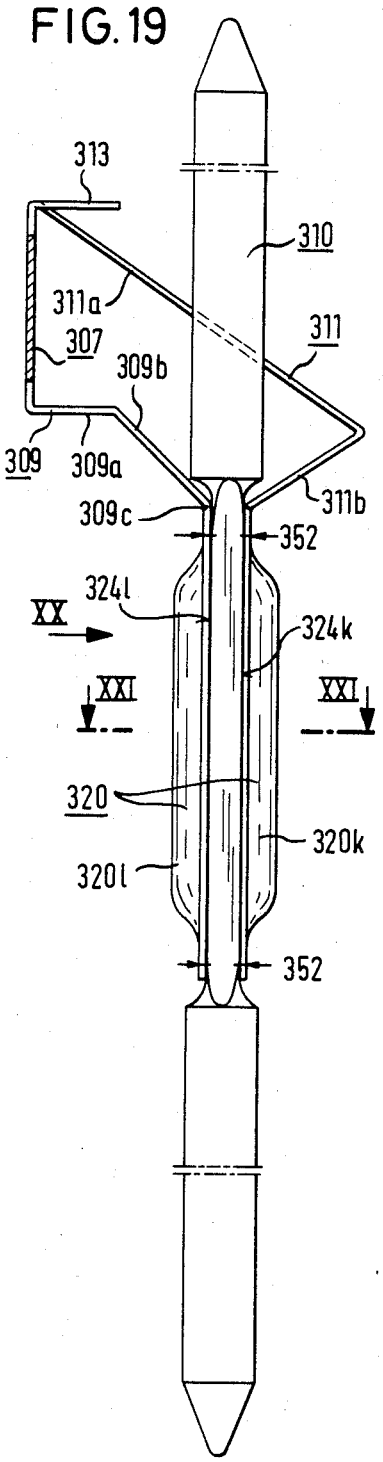
FIG. 19 shows an elevation of the contact pin package shown in FIG. 18*c* in the direction of the arrow XIX of FIG. 18*c;*

To the carrier strip 307 there have been attached tabs 313 which form, together with the carrier strip 307, a U-section, as can be seen particularly clearly in FIG. 19.

Figure 20:
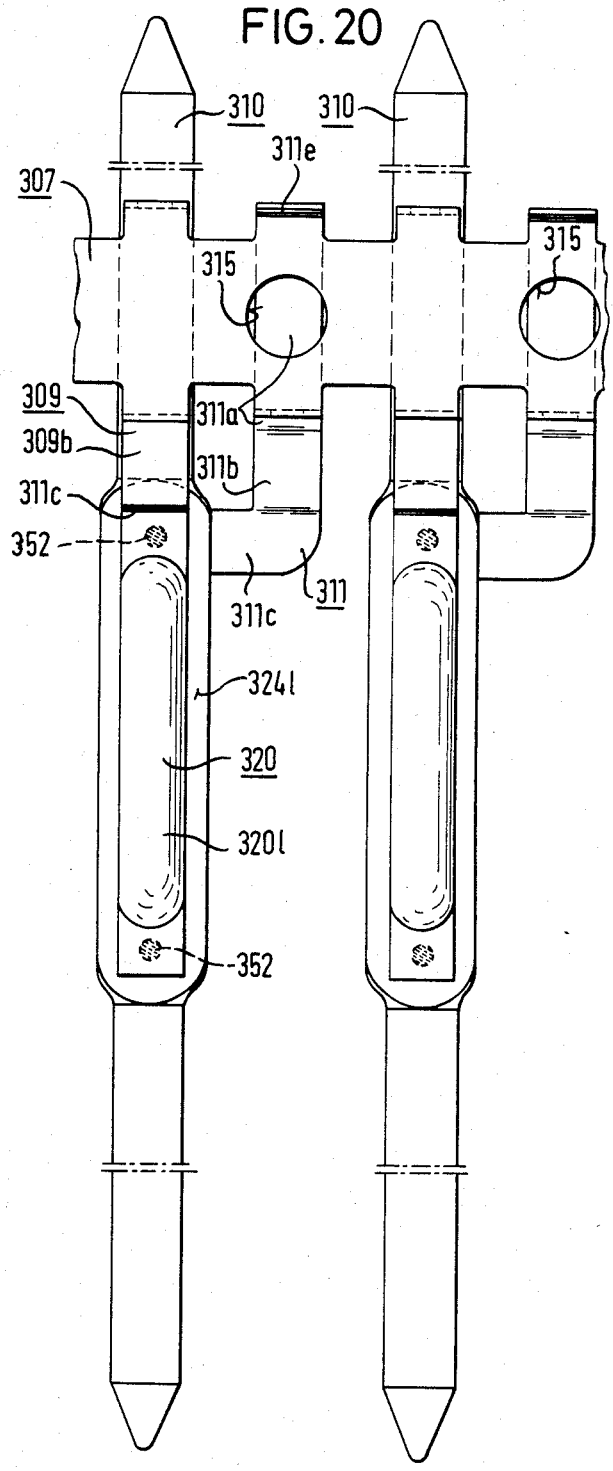
FIG. 20 shows an elevation view in the direction of the arrow XX of FIG. 19.

FIG. 20 shows an elevation of the completed magazine strip. FIG. 19 shows the stiff connection of the contact pins 310 to the carrier strip 307 by the two connection strips 309 and 311. FIGS. 18*b* and 20 furthermore reveal pilot holes 315 in the carrier strip 307. These pilot holes 315 serve for the indexing of the carrier strip 307 in a processing machine.

Figure 18A:
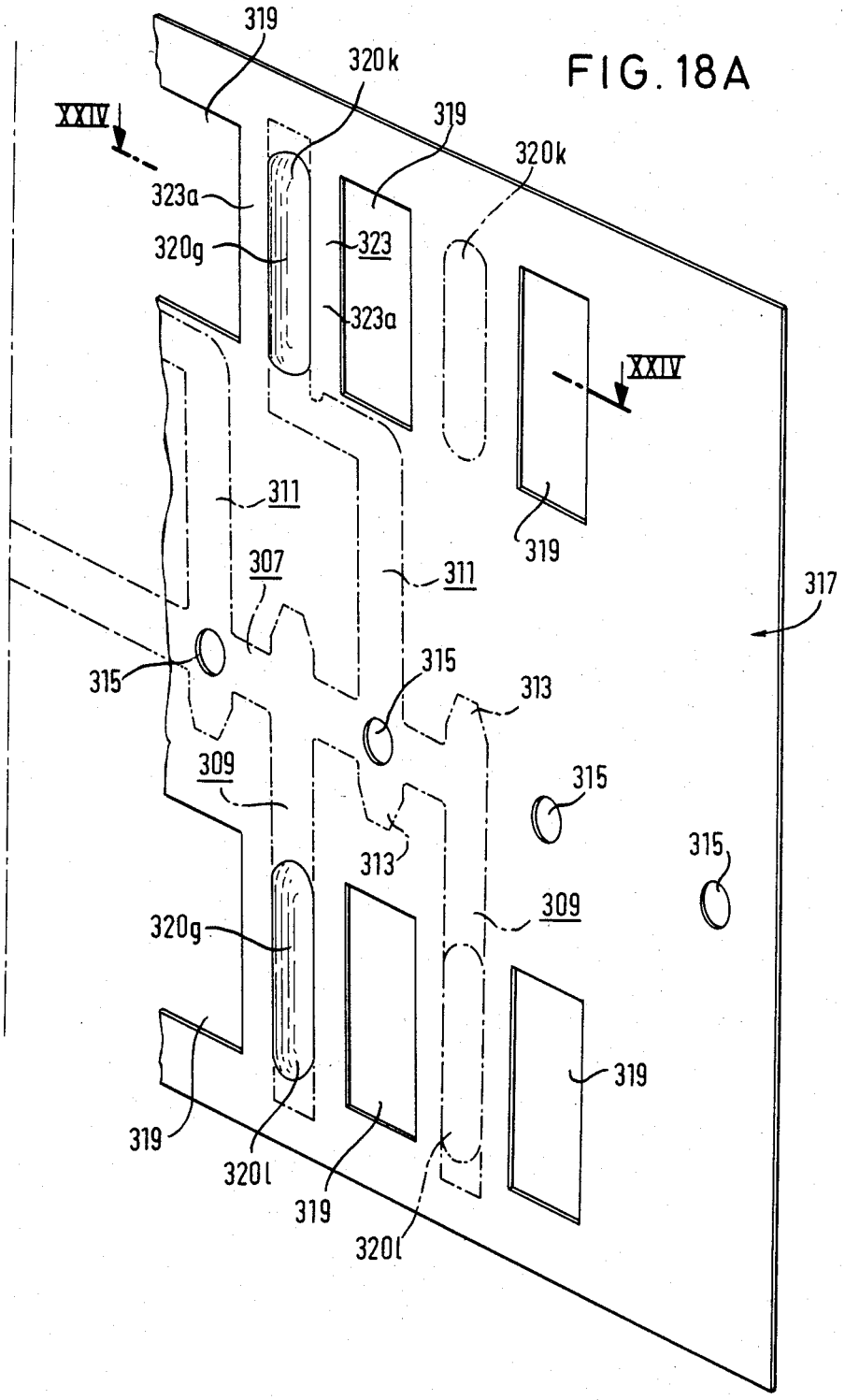
Figure 18B:
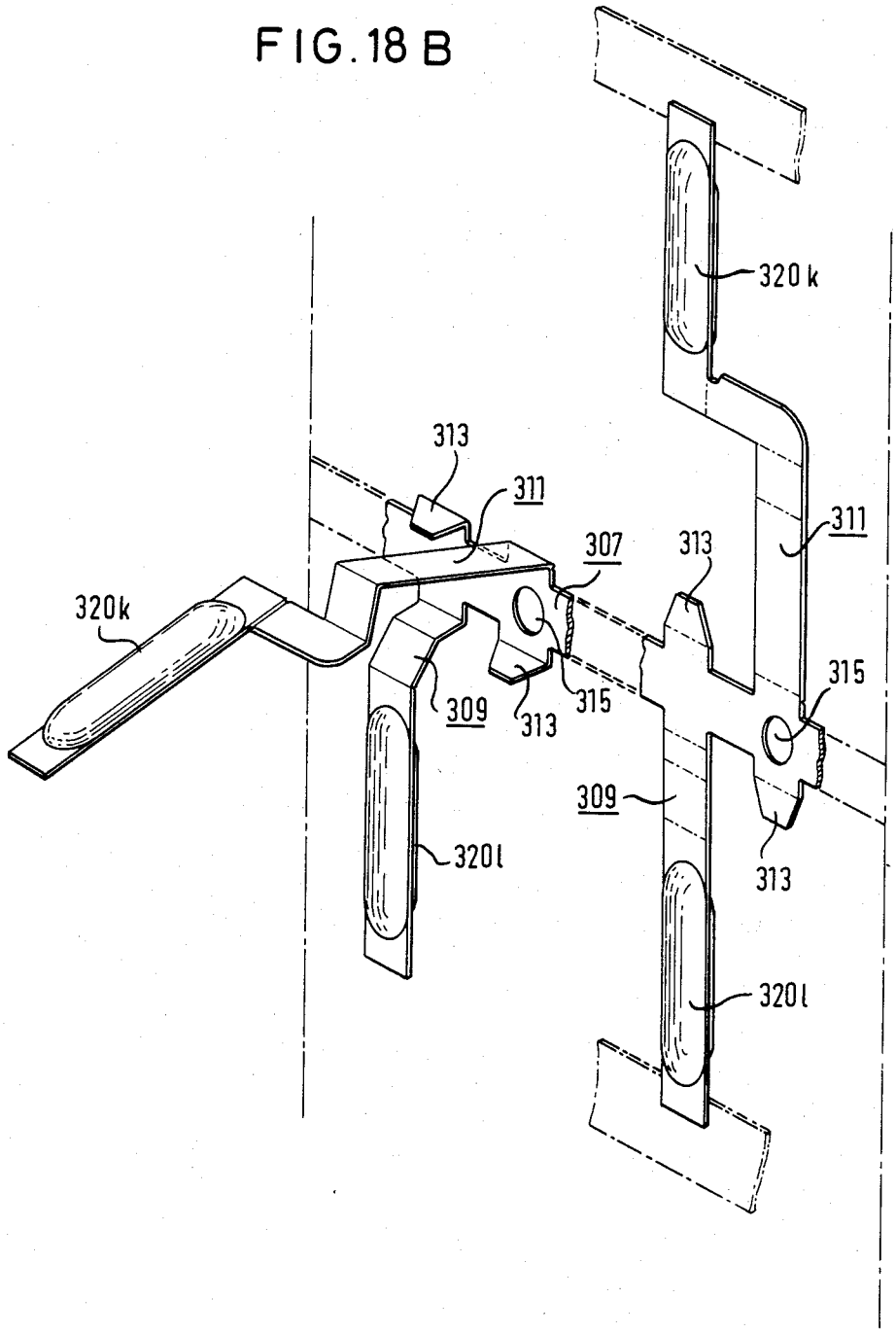

FIGS. 18*a* and 18*b* show how the magazine strip shown in FIG. 18*c* is formed from an initially flat sheet-metal strip 317. First, the pilot holes 315 are stamped out in this sheet-metal strip 317 so as to render possible the step-by-step indexing of the sheet-metal strip during the further processing stages in the strip stamping and bending machine. Then the windows 319 are stamped out because of the curving of the curvatures 320*g* of the contact springs 320*k* and 320*l*. Now reference is made to FIG. 24. The windows 319 are stamped from the sheet-metal strip 317 by means of a stamping die 321. The webs 323 left between successive windows 319 are then clamped in their edge zones 323*a* between a lower clamping plate 325 and an upper clamping plate 327, whereupon a curving die 329 produces the curvature 320*g* in the central zone of the web 323. The clamping force between the clamping jaws 325 and 327 is so set that the edge zones 323*a* of the webs 323 between the clamping jaws 325, 327 can be re-drawn during the curving operation as tension is produced in the curvature zone 320*g* in the direction of the curved arrow 331. Therefore, a substantial reduction in the material thickness does not occur in the curvature zone 320*g*.

Figure 24:
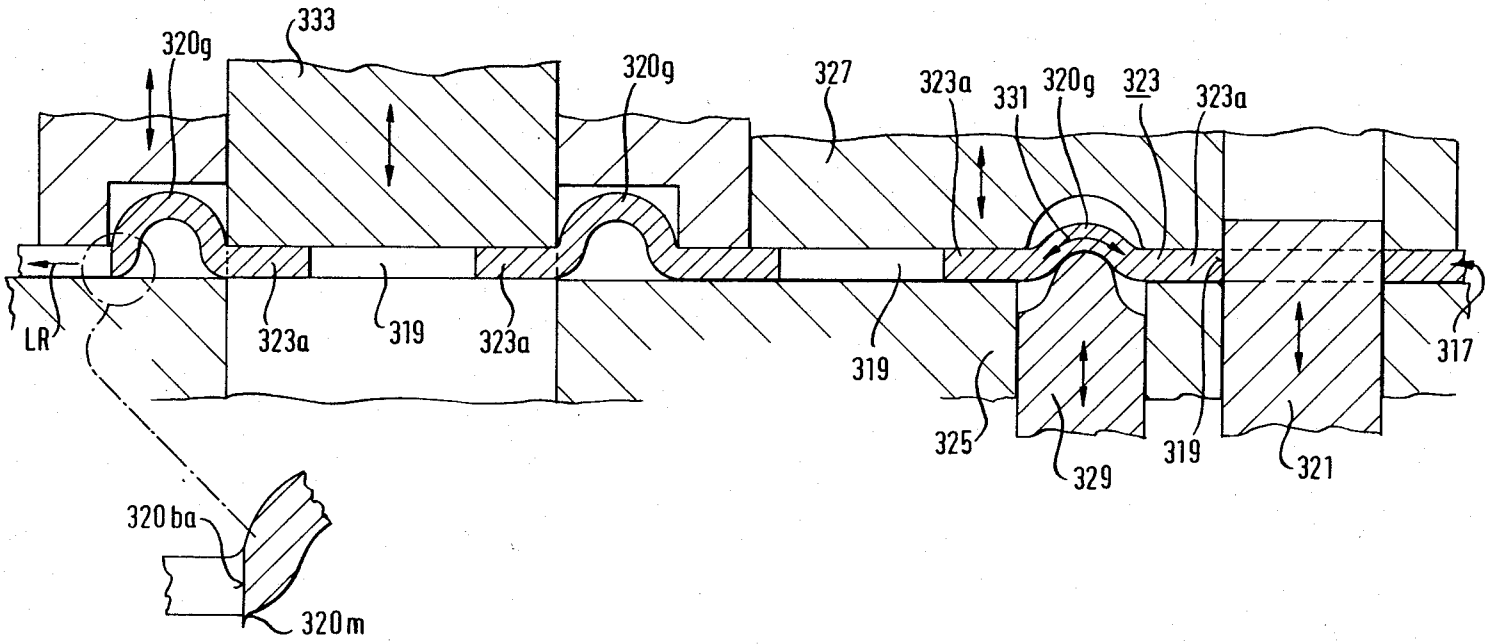
FIG. 24 shows the production of the curvatures in the contact springs along with a stretch orientation in a cut-out XXIV—XXIV of FIG. 18*a;*

As can be seen in FIG. 24, the edge zones 323*a* of the webs 323 are then, in another stamping stage (left-hand zone of FIG. 24), cut off from the curvature zones 320*g* by a trimming die 333. The trimming die 333 may form part of a cutting tool which forms the carrier strip 307 and the connection strips 309, 311, as well as of the tabs 313 within a still coherent filigree strip as shown by dash-dotted lines in FIG. 18*a*.

FIG. 18*b* shows how there is effected from the filigree strip indicated in dash-dotted lines in FIG. 18*a* by several bending operations the transition to the state shown on the right-hand side of FIG. 18*c* and finally to the state shown on the left-hand side of FIG. 18*c*. In the course of this transition, the contact pins 310, which are supplied in the direction of the arrow 335, in FIG. 18*c* are welded to the two contact springs 320*k* and 320*l*.

As can be seen in FIG. 24, ridges or flashes 320*m* are formed in the edge zones of the curvatures 320*g* during removal of the edge zones 323*a* by the trimming die 333.

Figure 21:
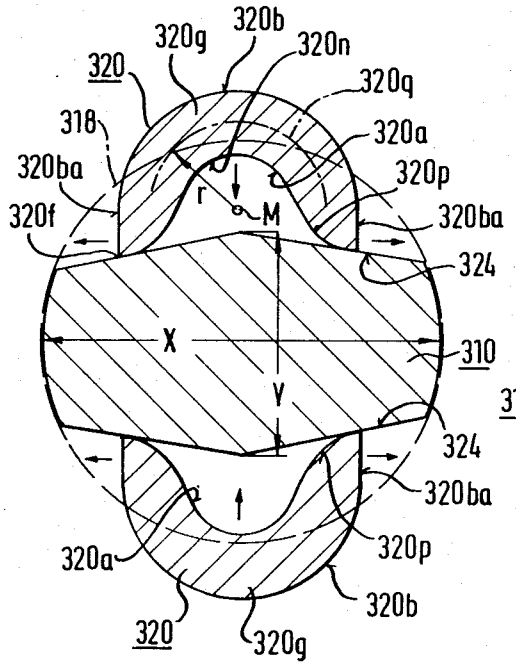
FIGS. 21 to 23 show different cross-sectional shapes of basic pins and contact springs which have been subjected to bending, taken along the line XXI—XXI of FIG. 19.

In FIG. 21, there is shown on an enlarged scale the shape of the curvature 320*g* which has come about from FIG. 24. However, in this constructional form, the flashes 320*m* have been omitted. The internal side 320*a* of the curvature 320*g* is composed of a concave top zone 320*n* and convex edge zones 320*p*. These convex zones 320*p* abut the lateral surfaces 324 which are designed as roof-shaped surfaces. In this combination of the configuration of the lateral surface 324 and the configuration of the curvature edges there is ensured a dig-in-free sliding of the curvature edges 320*f* on the roof-shaped lateral surfaces 324, so that the friction occurring at this point does not contribute to any considerable degree to the increase of the spring force in the contact spring 320. Responsible for a high contact spring force is here only the geometry of the curvature and the internal stretch orientation in the curvature zone 320*g*. To explain the geometry of the curvature zone 320*g*, there has been introduced the central circle of curvature 320*q* which lies approximately in the centre between the external surface 320*b* and the internal surface 320*a*. This circle of curvature 320*q* has a radius of curvature r. The length of the radius of curvature r is approximately $\frac{1}{2}$ of half the length of the long axis X. The distance of the centre of curvature M from the lateral surface 324 is approximately $\frac{1}{3}$ of the radius of curvature r.

The external edge zones of the external side 320*b* have been designated 320*ba;* resulting from the cutting operation according to the left-hand half of FIG. 24, they are substantially parallel to the short cross-sectional axis Y.

Figure 22:
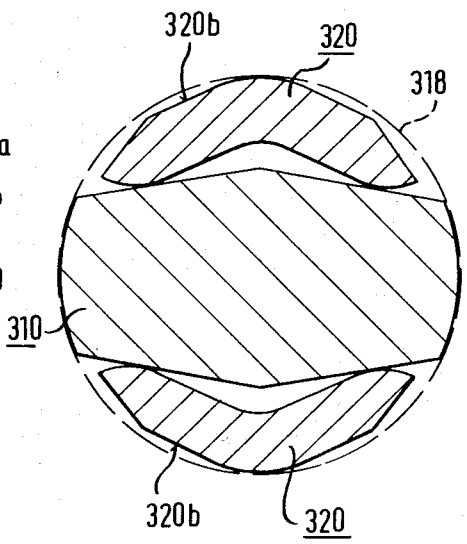

FIG. 22 shows the adaptation of the external surface 320*b* to the contour of the plug socket 318 upon a deformation of the springs 320 by the insertion thereof into the plug socket 318.

Figure 23:
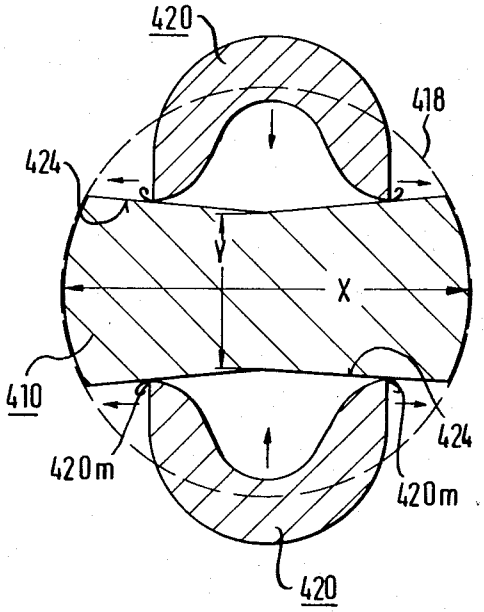

The constructional form shown in FIG. 23 differs from that shown in FIG. 21 in that the lateral surfaces 424 are designed as flat-trough surfaces. At the same time, the edge ridges 420*m* have been left herein, so that there exists a very high coefficient of friction between the edge ridges 420*m* and the flat-trough surfaces 424 and there may even occur the removal of stock as the contact springs 420 are flattened, as shown in FIG. 23.

Figure 25:
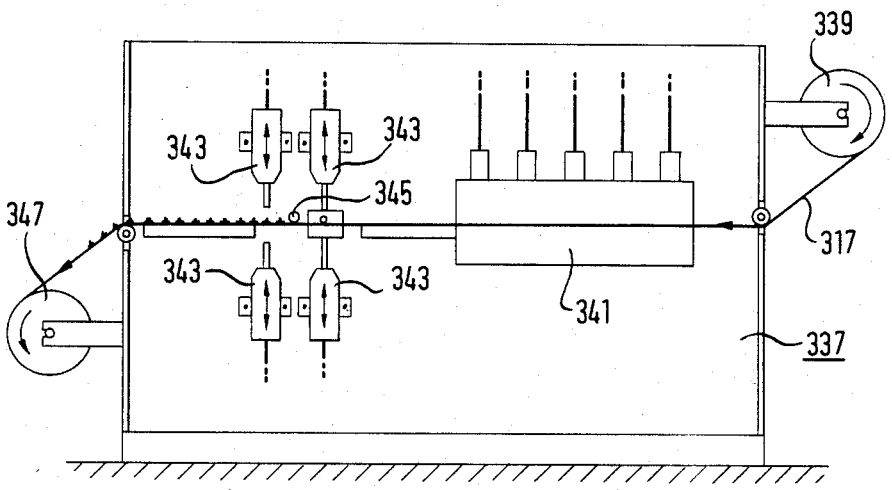
FIG. 25 shows a diagrammatical view of a processing machine for the production of a magazine strip of contact pin packages according to the invention from a sheet-metal strip, for supplying the contact springs subjected to bending stress and the basic pins.

In FIG. 25, there is shown the block diagram of a strip stamping and bending machine 337. One discerns therein a strip material supply 339, from which the sheet-metal strip 317 is unwound. In a stamping and curving unit 341 there are effected the stamping and curving operations shown in FIG. 18*a* and the right-hand half of FIG. 18*b*. The bending operations, as shown in the left-hand half of FIG. 18*b* and the right-hand half of FIG. 18*c*, are effected by diagrammatically indicated bending units 343. The basic pins are supplied vertically to the drawing plane of FIG. 25 approximately at 345. The completed magazine strip is then rolled onto a supply reel 347.

Figure 26:
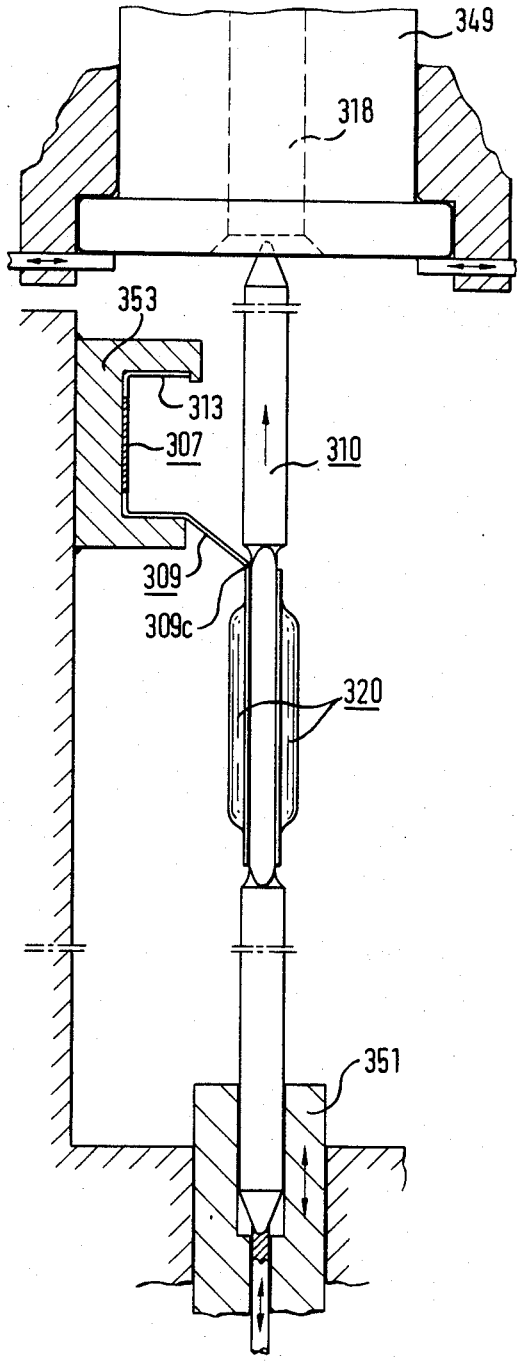
FIG. 26 shows a diagrammatical representation of the operation of the insertion of a magazine strip shown in FIGS. 18*c,* 19 and 20 into a contact pin reception carrier.

According to FIG. 26, a magazine strip, such as shown in FIGS. 19 and 20, is pushed into a basic-pin reception carrier 349 which is provided with diagrammatically indicated plug sockets 318. Prior to this push-in operation, the second connection strips 311 were broken off so that only the first connection strips 309 are still in existence, to hold the contact pin units on the carrier strip 307 which has been expanded to form a U-shaped guide section. Pushing-in is effected by push-in dies 351. During this push-in operation there occurs, possibly following the bending of the first connection strips 309, a breakage at the pre-determined breaking point 309*c*. The carrier strip 307 is guided in a guideway 353 of the device. It is also possible, following the partial pushing-in of the contact pin packages into the sockets 318, to tear off the carrier strip 307 in a zip-like manner, for example by means of an auxiliary tool, along with the breakage of the pre-determined breaking points 309*c*.

Figure 27:
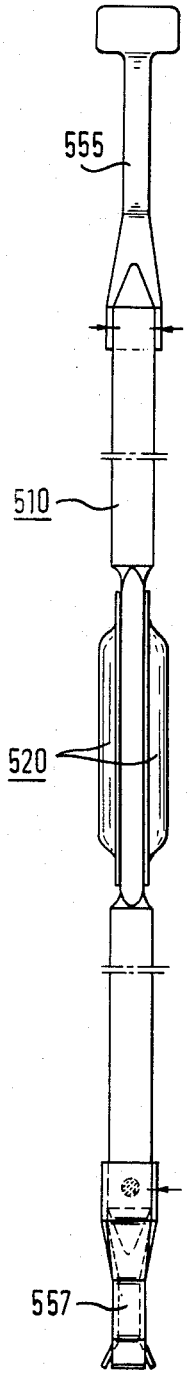
FIG. 27 shows a contact pin package according to the invention in conjunction with connection parts at the two ends of the basic pin.

As shown in FIG. 27, there are fitted to both ends of a basic pin 510 soldering lugs 555 and plug contacts 557, so as to illustrate the many possibilities of designing the basic pins 510 with contact springs 520 according to the invention.

Figure 28:
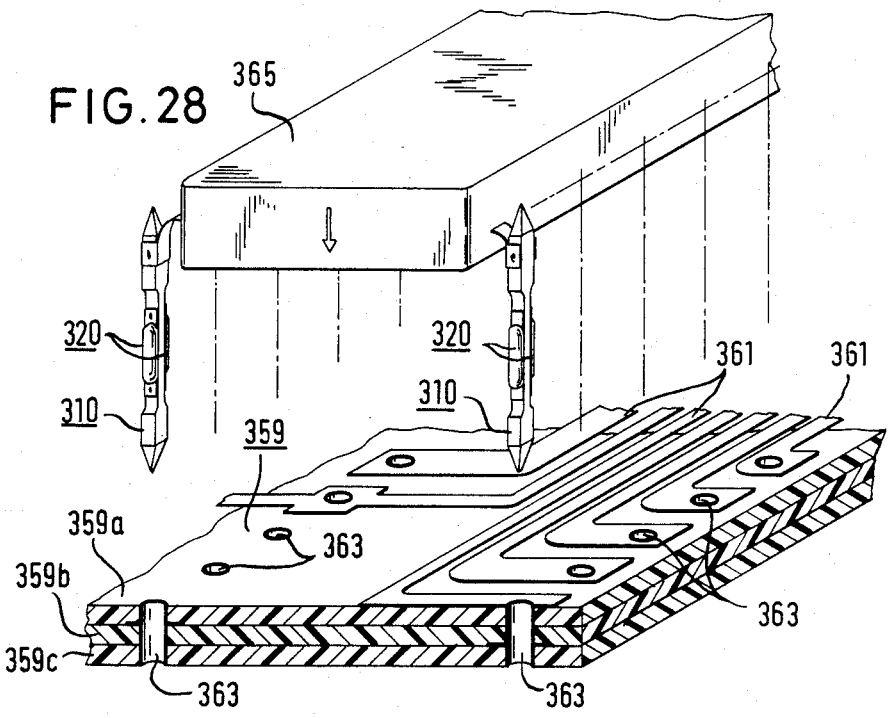
FIG. 28 shows the application of contact pin packages according to the invention for the electrical connection of a chip to a multi-layer printed-circuit board.

In FIG. 28, a multi-layer printed-circuit board is designated 359. This multi-layer printed-circuit board 359 consists of three layers 359*a*, 359*b* and 359*c*. Printed conductors are provided on each of these layers. Through each of these printed conductors passes a plug-in hole 363, which passes through all the layers. Depending on the position of the printed conductors on the different layers (359*a*, 359*b* and 359*c*), the basic pins 310 engage, with their contact springs 320, in the printed conductors on the various layers at different levels of the plug holes 363. The basic pins 310 may be fastened, for example, to a chip 365. Because of their shape, the springs 320 abut each layer 359*a*, 359*b* or 359*c* with the desired contact pressure so that it is also possible, for example, to connect electrically printed conductors of different tiers, even if the hole width has tolerance differences in the different tiers. In fact, the extent of the flattening of the springs 320 may vary from tier to tier.

The basic pins 310 shown in FIGS. 21 to 23 may be made, for example, of phosphor bronze metal or beryllium bronze. The contact springs 320 are preferably made of stainless steel and coated with copper. As regards the dimension ratios, there applies what has been stated in connection with the exemplified embodiments according to FIGS. 1 to 29.

Figure 29:
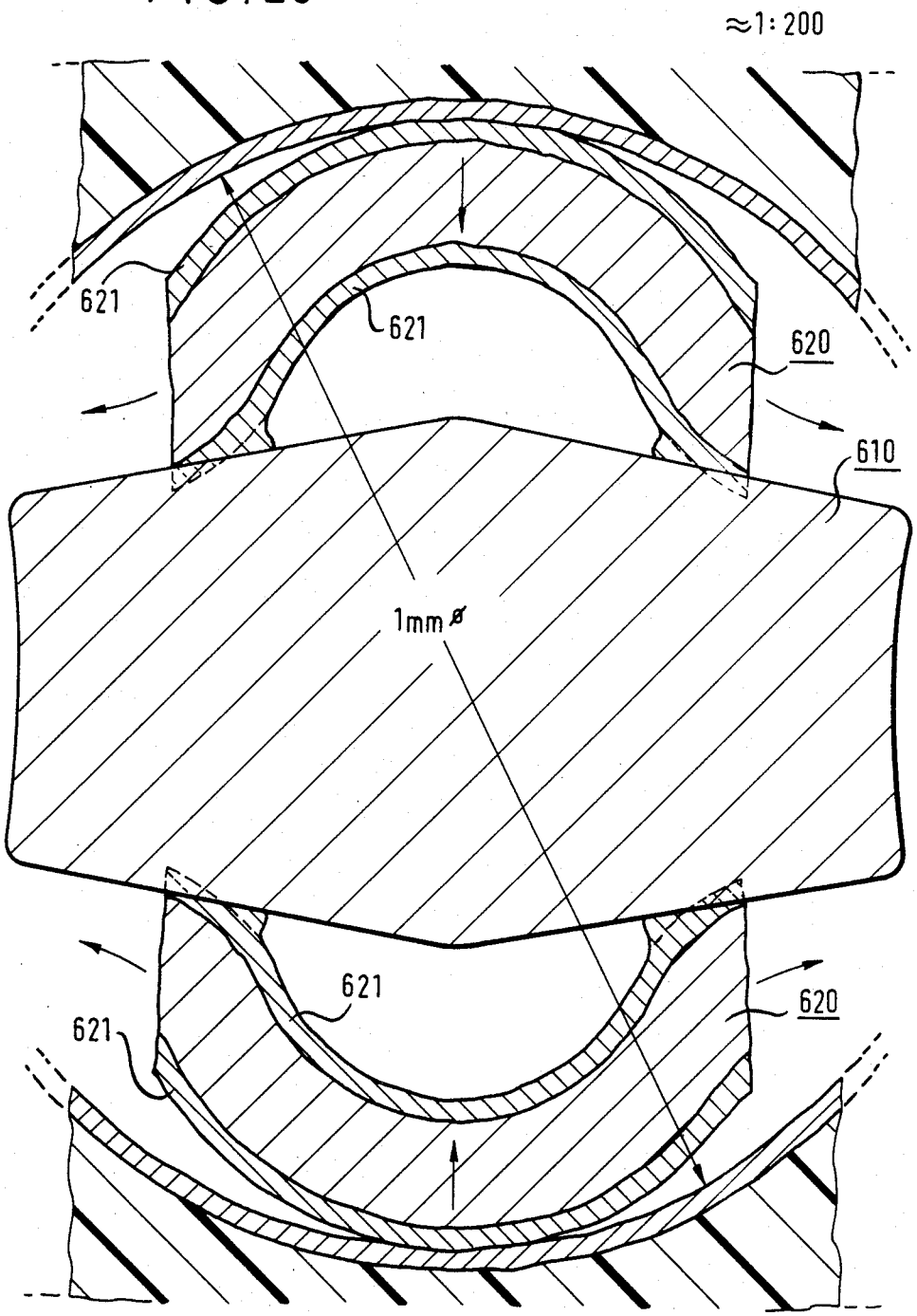
FIG. 29 shows an enlarged sectional view in a plane of section corresponding to that of FIG. 22.

The sectional representation of FIG. 29 has been drawn according to a micrograph. One discerns that the springs 620, which are made, for example, of V2A steel, are coated with copper layers 621. These copper layers 621 are relatively soft, compared to the material of the contact pin 610, so that they can be deformed as the springs 620 are flattened, as can be seen in FIG. 29. In fact, it has been found that the edge zones of the copper layers 621 abutting the basic pin 610 can be squeezed from the original shape shown by the broken line into the foot shape shown in solid lines. This foot shape ensures a relatively large-surface abutting contact between the basic-pin-side copper layers 621 and the basic pin 610, resulting in a low transitional resistance at the contact points and a correspondingly low voltage drop. This phenomenon is independent of whether or not there are provided ridges on the edges of the springs 620, as indicated in FIG. 24 at 320*m*.

I claim:

1. A small-sized electrical contact pin unit for engagement with an internal surface (18) of a plug socket (14) capable of being provided in a device such as a printed circuit board, said internal surface (18) having an approximately circular cross-sectional area, said contact pin unit comprising an elongate basic pin (10) having a longitudinal axis and longitudinally arranged opposite end portions, a partial section (A) being elongate over at least part of the axial length of the basic pin (10) between said longitudinally arranged opposite end portions, said partial section (A) having lateral faces (24, 26), said partial section (A) having a long cross-sectional axis (X), whose length corresponds approximately to the inside diameter of said internal surface (18) so as to provide centering of the basic pin (10) in the plug socket 14, and a short cross-sectional axis (Y), at least one (24) of said lateral faces (24, 26) being substantially perpendicular to the short cross-sectional axis (Y) within said partial section of said basic pin (10), a contact spring (20) elongate in said axial direction, said contact spring being laterally supported on said one lateral face (24) in a direction perpendicular to the longitudinal axis of the basic pin (10) without extending over either of the longitudinally extending opposite end portions of said basic pin and being conductively connected to said basic pin, said contact spring (20) being dimensioned such as to make electric contact with said internal surface (18) of said plug socket (14) with radial pressure substantially perpendicular with respect to said one lateral face (24), said contact spring (2) being formed of sheet metal and, considered in a cross-section that is perpendicular to the longitudinal axis of the basic pin (10), said contact spring (20) being curved and having a substantially concave internal side (20*a*), which is directed towards the basic pin (10), and a substantially convex external side (20*b*) which is directed towards the internal surface (18) of the plug socket (14) when the contact pin unit is mounted in the socket.

2. A contact pin unit as claimed in claim 1, wherein, considered in said cross-section perpendicular to the longitudinal axis of the basic pin, the external side (20*b*) has a radius of curvature which is slightly smaller than or, at the most, equal to the inside radius of the internal surface (18) of the plug socket (14).

3. A contact pin unit as claimed in claim 1, wherein the contact spring (20) extends in an arc-shaped manner along said longitudinal axis of said basic pin (10), with a concave arc curvature that is directed towards said one lateral face (24) and a convex arc curvature that is directed towards the internal surface (18) of the plug socket (14) when the contact pin is mounted in the socket.

4. A contact pin unit as claimed in claim 3, wherein, at least after the contact pin unit has been inserted into said plug socket (14), two axially spaced end portions of said contact spring (20) are supported on said one lateral face (24) of said basic pin (10).

5. A contact pin unit as claimed in claim 3, wherein the contact spring (20) is fastened to the basic pin (10) with a first end and abuts the partial section (A) of the basic pin (10) with its second end (20*a*) so as to be displaceable in the longitudinal direction of the latter.

6. A contact pin unit as claimed in claim 5, wherein, at its second end (20*a*), the contact spring (20) is opposite to a stop (34) which limits its displaceability in the longitudinal direction of the basic pin (10).

7. A contact pin unit as claimed in claim 6, wherein the stop (34) has been co-ordinated with the length of the contact spring and with the inside diameter of the plug socket (14) in such a way that the second end (20*a*) butts thereagainst before the contact spring (20) enters the plug socket (14).

8. A contact pin unit as claimed in claim 1, wherein the contact spring (20) has at least one axial end portion welded or soldered to the basic pin (10).

9. A contact pin unit as claimed in claim 1, wherein each of two radially opposite lateral faces (24) perpendicular to the short cross-sectional axis (Y) are each provided with a contact spring (20), said contact spring (20) being made from sheet metal.

10. A contact pin unit as claimed in claim 9, wherein a connection part (28) is U-shaped and has a web (28*a*), which abuts a basic pin (10) lateral surface zone (30*a*) that is perpendicular to the long cross-sectional axis (X) of the partial section (A), and two legs (28*b*) which abut the partial section (A) lateral surfaces (24) that are perpendicular to the short cross-sectional axis (Y) of the partial section (A), and in that the contact springs (20) extend from respective legs (28*b*).

11. A contact pin unit as claimed in claim 10, wherein the web (28*a*) abuts a basic pin (10) lateral surface zone (30*a*) that is perpendicular to the long cross-sectional axis (X) of the partial section (A) and which is set back, in relation to the associated partial section (A) lateral surface (26) that is defined by the long cross-sectional axis (X), towards the basic pin axis.

12. A contact pin unit as claimed in claim 10, wherein the web (28*a*) and/or at least one of the legs (28*b*) have been soldered or welded together with the basic pin (10) lateral surface zone which respectively butts thereagainst.

13. A contact pin unit as claimed in claim 1 wherein the lateral faces (26, 326) substantially perpendicular to said long cross-sectional axis (X) of said partial section (A) are convexly rounded towards the internal surface (18, 318) of the plug socket (14).

14. A contact pin unit as claimed in claim 1 wherein the lateral faces (126, 326) perpendicular to said long cross-sectional axis (X) of said partial section (A) converge towards each other at at least one end of said partial section (A); said one end being intended for being introduced first into said plug socket (14).

15. A contact pin unit as claimed in claim 1 wherein said partial section A has been formed by flattening a piece of wire forming the basic pin (10, 310).

16. A contact pin unit as claimed in claim 15, wherein the piece of wire (10, 310) has a square cross-sectional area with two transverse intersecting central axes, and wherein said axes (X,Y) of said flattened partial section (A) are parallel to said transverse intersecting central axes.

17. A contact pin unit as claimed in claim 15, wherein a stop (34) for the contact spring (20) is formed by the transition shoulder from the flattened partial section (A) to an adjoining undeformed wire section (C), there being, if necessary, integrally formed with this transition shoulder (34) a holding nose (36) which engages over the contact spring, at least after it has reached the stop (34).

18. A contact pin unit as claimed in claim 15 wherein the partial section (A) has, at at least one end, a flattened transition section (D), whose short cross-sectional axis corresponds in its length to the short cross-sectional axis (Y) of the flattened partial section (A) and whose long axis corresponds to the corresponding axis of the undeformed piece of wire or is smaller than this axis, and in that the connection part (28) abuts this transition section (D).

19. A contact pin unit as claimed in claim 15 wherein the legs (28*b*) of the connection part (28) abut, with their edges (28*c*) that are remote from the contact springs (20), transition shoulders (32) between the flattened partial section (A) and an adjoining section (B) of the undeformed piece of wire (10).

20. A contact pin unit as claimed in claim 1, wherein the inside diameter of said internal surface (18, 318) of said plug socket is smaller than 2.5 mm, more especially approximately 1 mm.

21. A contact pin unit as claimed in claim 1, wherein the ratio of the length of the long axis (X) of said partial section (A) to the length of the short axis (Y) of said partial section (A) is in a range of 1.5:1 to 4:1, preferably approximately 2:1 to 3:1.

22. A contact pin unit as claimed in claim 1, wherein the thickness of the sheet metal is approximately 5/100 to approximately 20/100 mm.

23. A contact pin unit as claimed in claim 1, wherein the ratio of the axial length of the partial section (A) to the inside diameter of the internal surface (18, 318) of the plug socket is about 2:1 to about 4:1, preferably approximately 3:1.

24. A contact pin unit as claimed in claim 1, wherein the plug socket is formed by a hole the internal surface of which has been metalized, more especially a tin-coated hole (18) in a printed-circuit board (16).

25. A contact pin unit as claimed in claim 1, wherein the contact spring (220, 320) has a rounded or pointed contour adjacent at least one of its ends, said at least one end being introduced first when said contact pin unit is introduced into said plug socket (14).

26. A contact pin unit as claimed in claim 1, wherein the one lateral face (24) is substantially roof-shaped and substantially perpendicular to the short cross-sectional axis (Y).

27. A contact pin unit as claimed in claim 1, wherein the one lateral face (24) is substantially trough-shaped and substantially perpendicular to the short cross-sectional axis.

28. A method for the production of a contact pin package as claimed in claim 1 wherein two contact springs (220) with a U-shaped connection piece (228) are placed, transversely to the longitudinal axis of the basic pin, on this pin and may be welded thereto.

29. A small-sized electrical contact pin unit for engagement with an internal surface (318) of a plug socket capable of being provided in a device such as a printed circuit board, said internal surface (318) having an approximately circular cross-sectional area, said contact pin unit comprising an elongate basic pin (310) having a longitudinal axis, a partial section (A) being elongate and extending over at least part of the axial length of the basic pin (319), said partial section (A) having lateral faces (324, 326), said partial section (A) having a long cross-sectional axis (X), whose length corresponds approximately to the inside diameter of said internal surface (318) so as to provide centering of the basic pin (310) in the plug socket, and a short cross-sectional axis (Y), at least one (324) of said lateral faces (324, 326) being substantially perpendicular to the short cross-sectional axis (Y) within said partial section (A) of said basic pin (310), a contact spring (320) elongate in said axial direction being supported on said at least one lateral surface (324) and being conductively connected to said basic pin (310), said contact spring (320) being dimensioned such as to make electric contact with said internal surface (318) of said plug socket with radial pressure substantially perpendicular with respect to said one lateral face (324), said contact spring (320) being formed of sheet metal and, considered in a cross-section that is perpendicular to the longitudinal axis of the basic pin (310), said contact spring (320) being curved and having substantially concave internal side (320*a*), which is directed towards the basic pin (310), and a substantially convex external side (320*b*) which is directed towards the internal surface (318) of the plug socket when the contact pin unit is mounted in the socket, said contact spring (320) also having longitudinal edge zones (320*f*) substantially parallel to said longitudinal axis, said longitudinal edge zones (320*f*) engaging said one lateral face (324) substantially over the entire length of said edge zones (320*f*) when said contact pin unit has been introduced into engagement with said internal surface (318) of said plug socket.

30. A contact pin unit as claimed in claim 29 wherein in an untensioned state of the contact spring, a central circle of curvature (320*f*) of a curvature (320*g*) of the contact spring (320) as regarded in a plane perpendicular to said longitudinal axis, has a centre (M) outside the respective lateral face (324) which is substantially perpendicular to the short cross-sectional axis (Y) and has a radius of curvature (r) which is substantially smaller than half of the long cross-sectional axis (X).

31. A contact pin unit as claimed in claim 30, wherein the distance of the centre (M) of the central circle of curvature (320*g*) from the respective lateral face (324) that is vertical to the short cross-sectional axis (Y) is approximately one third to approximately two thirds, preferably approximately one half of the radius of curvature (r) of the central circle of curvature (320*q*).

32. A contact pin unit as claimed in claim 30, wherein the radius of curvature (r) of the central circle of curvature (320*q*) is approximately one third to approximately two thirds, preferably approximately one half of half the length of the long cross-sectional axis (X).

33. A contact pin unit as claimed in claim 30, wherein an internal side (320*a*) of the contact spring (320), when regarded in a sectional plane perpendicular to said longitudinal axis, is concavely curved in a topzone (320*n*) and convexly curved in an edge zone (320*f*).

34. A contact pin unit as claimed in claim 33, wherein the contact spring (320) abuts, with a convexly curved internal surface (320*p*) of the edge zone (320*f*), the respective lateral face (324) that is substantially perpendicular to the short cross-sectional axis (Y).

35. A contact pin unit as claimed in claim 29, wherein the respective lateral face (324) which is substantially perpendicular to the short cross-sectional axis (Y) is designed as a plane surface or roof surface.

36. A contact pin unit as claimed in claim 29, wherein the contact spring (420) abuts, with sharp edges (420*m*), the respective lateral face (424) that is substantially perpendicular to the short cross-sectional axis (Y).

37. A contact pin unit as claimed in claim 29, wherein the lateral face (424) which is substantially perpendicular to the short cross-sectional axis (Y) is designed as a flat-trough surface.

38. A contact pin unit as claimed in claim 29, wherein the contact spring 320, when regarded in a sectional plane perpendicular to said longitudinal axis, has an external side (320*b*) which is convex in an apex zone and is substantially parallel to the short cross-sectional axis (Y) in another edge zone (320*ba*).

39. A contact pin unit as claimed in claim 29, wherein the material of the contact spring (320), when regarded in a sectional plane perpendicular to said longitudinal axis, is oriented by having been circumferentially stressed during curve shaping.

40. A contact pin unit as claimed in claim 29, wherein the lateral faces (324, 326) of the partial section (A) merge in a substantially continuous (stopless) manner with corresponding lateral faces of the basic pin (310).

41. A contact pin unit as claimed in claim 40, wherein said basic pin (310) is provided with a wire coil (301) coiled around the basic pin at a location outside said partial section (A).

42. A contact pin unit as claimed in claim 29 wherein the basic pin (510) is provided with a plug contact part (555, 557) at at least one end.

43. A contact pin package comprising a plurality of contact pin units as claimed in claim 29, wherein the plurality of contact pin units (310) are coherent in the form of a magazine strip.

44. A contact pin package as claimed in claim 43, wherein the contact springs (320) have been made from a sheet-metal strip (317) by stamping and bending.

45. A contact pin package as claimed in claim 44 wherein pre-determined breaking points (309*C*, 311*d*, 311*e*) are provided between the contact springs (320) and remainders of the sheet-metal strip (317) which connect the basic pins (310) to the magazine strip.

46. A contact pin package as claimed in claim 44, wherein the basic pins (310) have been connected to the magazine strip by parts from the sheet-metal strip (317) which were left during the formation of the contact springs (320).

47. A contact pin package as claimed in claim 46, wherein pre-determined breaking points (309*c*, 311*d*, 311*e*) are provided between the contact springs (320) and remainders of the sheet-metal strip (317) which connect the basic pins (310) to the magazine strip.

48. A contact pin package as claimed in claim 46 wherein remainders of the sheet-metal strip (317) which connect the basic pins (310) to the magazine strip are provided with guide means (313) and/or indexing means (315) for transporting the magazine strip through processing devices.

49. A contact pin package as claimed in claim 46, wherein sheet-metal strip (317) remainders connecting the basic pins (310) to the magazine strip comprise a carrier strip (307) which extends transversely to the axial direction of the basic pins and parallel to the basic pin lateral faces (324) carrying first contact springs (320*l*), on one side (324*l*) of the basic pins (310), and in that this carrier strip (307) is connected to the contact springs (320*l*), which lie on the same side (324*l*) of the basic pins (310), via first connection strips (309) which substantially lie in a plane (E1) that is perpendicular to the longitudinal direction of the carrier strip (307) and passes through the respective basic pin (310) and is connected to second contact springs (320*k*), which lie on the other side (324*k*) of the basic pins (310), by second connection strips (311) which lie outside this plane (E1).

50. A contact pin package as claimed in claim 49, wherein the plane containing the carrier strip (307) is substantially parallel to the axial direction of the basic pins (310), and in that a first connection strip (309) has a first strip section (309*a*) substantially perpendicular to the plane of the carrier strip (307) and has a second strip section (309*b*) which is inclined towards the axial direction of the respective basic pin (310) and extends to the adjacent end of the respective contact spring (320*l*), there being provided a predetermined breaking point (309*c*) at the transition from the second strip section (309*b*) to the respective contact spring (320*l*).

51. A contact pin package as claimed in claim 49, wherein said second connection strip (311) has a strip section (311*a*, 311*b*) which is multiply angled and which, starting out from the carrier strip (307), lies in a plane (E2) that is substantially perpendicular to the longitudinal direction (LR) of the carrier strip (307) and that is laterally offset from the respective basic pin (310) and has a continuation strip section (311*c*) which is substantially parallel to the carrier strip (307) and connects the multiply angled strip section (311*a*, 311*b*) to the contact spring (320*k*), the plane of the carrier strip (307) being substantially parallel to the axial direction of the basic pins (310), and a first partial section (311*a*) of the multiply angled strip section (311*a*, 311*b*) adjoining the carrier strip (307) at a first angle $\beta$ and projecting beyond the associated basic pin (310) lateral faces (324*k*) that are remote from the carrier strip, and a second partial section (311*b*) of the multiply angled strip section (311*a*, 311*b*) returning at a second angle $\gamma$ with respect to the first partial section (311*a*) into the plane of the lateral face (324*k*) that is remote from the carrier strip (310) and adjoining the continuation strip section (311*c*), and predetermined breaking points (311*e* and 311*d* respectively) being provided at a transition from the carrier strip (307) to the first partial section (311*a*) and a transition from the continuation strip section (311*c*) to the respective contact spring (320*k*).

52. A contact pin package as claimed in claim 49 wherein the carrier strip (307) has been stiffened by tabs (313) which are angled substantially perpendicularly to its plane and result in a substantially U-shaped guide section.

53. A contact pin package as claimed in claim 49 wherein the two ends of the basic pins (310) project, in the axial direction thereof, beyond the carrier strip (307) and the connection strips (309, 311).

54. A method for the production of a contact pin package as claimed in claim 49 while using basic pins and a sheet-metal strip providing the contact springs, wherein the sheet-metal strip (317) is moved in a feed direction (LR) perpendicularly to a supply direction of the basic pins (310), and wherein there is obtained from the sheet-metal strip by stamping operations a filigree strip containing the contact springs (320*l*, 320*k*) for the respective lateral faces (324*k*, 324*l*) of the basic pin (310), the carrier strip (307) and the connection strips (309, 311), and in that the basic pins (310) are placed, with one lateral face (324*l*), against the respective first contact springs (320*l*) and wherein thereupon the second contact springs (320*k*) are folded onto the respective other lateral face (324*k*) of the basic pins (310).

55. A method for the production of a contact pin package as claimed in claim 54, wherein the basic pins (310) are fixed with the respective lateral faces (324*l*) to the first contact springs (320*l*) by one of the soldering and welding methods and in that the second contact springs (320*k*) are fastened to the respective lateral faces (324*k*) of the basic pins (310) by one of the welding and soldering methods.

56. A method for the installation of a section of a contact pin package as claimed in claim 49 into a basic pin reception carrier (349), wherein first the second connection strips (311) are cut off, and wherein the first connection strips (309 ) are broken off in one of the periods during or following the introduction of the basic pins (310) into the basic pin receptable carrier (349).

57. A method as claimed in claim 56, wherein the first connection strips (309) are broken off by displacing the basic pins (310) in their axial direction with respect to the carrier strip (307).

58. A contact pin package as claimed in claim 29, wherein the printed-circuit board (359) is designed as a multi-layer printed-circuit board, the contact spring being shaped such as to be able to contact a plurality of layers.

59. A method for the production of the contact springs for contact pin units as claimed in claim 29 wherein the contact spring, when considered in a section perpendicular to the longitudinal axis, is curved by a forming operation by which the spring material is oriented with a direction of orientation substantially parallel to the circumferential direction of the curve configuration.

60. A method as claimed in claim 59, wherein for the production of the contact springs (320) from a sheet-metal strip (317) there are provided prior to the production of the curve configuration (320 g) in the sheet-metal strip (317), at a distance from the edges of the respective contact spring (320) slots (319) in the sheet-metal strip (317), the edge zones (323*a*) of a material web (323) left between the slots (319) are clamped, a central zone of this material web (323) is curved and the edge zones (323*a*) are thereupon trimmed.

61. A contact pin unit as claimed in claim 29, wherein the contact spring (620) is provided, at least on its side that is directed towards the basic pin (610), with a coating (621) which is softer than the material of the contact spring (620) and the material of the basic pin (610) and is highly conductive, said softer layer being deformed such as to define an increased contact surface with the basic pin (610) when the contact spring (620) is operationally pressed against the basic pin (610).

62. A contact pin unit as claimed in claim 29, wherein said longitudinal edge zones (320*f*) engage said one lateral face (324) in the untensioned state, i.e. before inserting said contact pin unit into said plug socket (314).

63. A contact pin unit as claimed in claim 29, wherein said curved contact spring (320), when regarded in said cross-section, has a predetermined radius of curvature in an area adjacent an apex of said curved contact spring (320) in an untensioned state, i.e. before said contact pin unit is entered into said plug socket (314), said predetermined radius of curvature being increased by said radial pressure, i.e. when said contact pin unit is introduced into said plug socket (314).

64. A contact pin unit as claimed in claim 29, wherein the contact spring (320) has at least one axial end portion welded or soldered to the basic pin (310).

65. A contact pin unit as claimed in claim 29, wherein each of two radially opposite lateral faces (324) perpendicular to the short cross-sectional axis (Y) are each provided with a contact spring (320), said contact springs (320) being made from sheet metal.

66. A contact pin unit as claimed in claim 29, wherein the thickness of the sheet metal is approximately 5/100 to approximately 20/100 mm.

67. A contact pin unit as claimed in claim 29, wherein the lateral faces (326) substantially perpendicular to the long cross sectional axis (X) of the partial section (A) are convexly rounded towards the internal surface (318) of the plug socket.

68. A contact pin unit as claimed in claim 29, wherein the lateral faces (326) perpendicular to said long cross-sectional axis (X) of said partial section (A) converge towards each other at at least one end of said partial section (A); said one end being intended for being first introduced into said plug socket.

69. A contact pin unit as claimed in claim 29, wherein the partial section (A) has been formed by flattening a piece of wire forming the basic pin (310).

70. A contact pin unit as claimed in claim 69, wherein the piece of wire has a square cross-sectional area with two middle axes, and wherein said axes (X, Y) of said flattened partial section (A) are parallel to said middle axes.

71. A contact pin unit as claimed in claim 29, wherein the inside diameter of said internal surface (318) of said plug socket is smaller than 2.5 mm, more especially approximately 1 mm.

72. A contact pin unit as claimed in claim 29, wherein the ratio of the length of the long axis (X) of said partial section (A) to the length of the short axis (Y) of said partial section (A) is in a range of 1.5:1 to 4:1, preferably approximately 2:1 to 3:1.

73. A contact pin unit as claimed in claim 29, wherein the ratio of the axial length of said partial section (A) to the inside diameter of the internal surface (318) of the plug socket is about 2:1 to about 4:1, preferably approximately 3:1.

74. A contact pin unit as claimed in claim 29, wherein the plug socket is formed by a hole the internal surface of which has been metalized, more especially a tin-coated hole (318) in a printed-circuit board (316).

75. A contact pin unit as claimed in claim 29, wherein the contact spring (220) has a rounded or pointed contour adjacent at least one of its ends, said at least one end being introduced first when said contact pin unit is introduced into said plug socket.

76. A contact pin unit as claimed in claim 29, wherein said basic pin (310) is provided with a wire coil (301) coiled around the basic pin at a location outside said partial section (A).

77. A contact pin unit as recited in claim 29, wherein each of two radially opposite lateral faces (324) perpendicular to the short cross-sectional axis (Y) are each provided with a contact spring (320) being made of sheet metal.

78. A small-sized electrical contact pin unit for engagement with an internal surface (318) of a plug socket capable of being provided in a device such as a printed circuit board, said internal surface (318) having an approximately circular cross-sectional area, said contact pin unit comprising an elongate basic pin (310) having a longitudinal axis, a partial section (A) being elongate and extending over at least part of the axial length of the basic pin (310), said partial section (A) having lateral faces (324, 326), said partial section (A) having a long cross-sectional axis (X), and a short cross-sectional axis (Y), at least one (324) of said lateral faces (324, 326) being substantially perpendicular to the short cross-sectional axis (Y) within said partial section of said basic pin (310), a contact spring (320) elongate in said axial direction being supported on said at least one lateral surface (324) and being conductively connected to said basic pin (310), said contact spring (320) being dimensioned such as to make electric contact with said internal surface (318) of said plug socket with radial pressure substantially perpendicular with respect to said one lateral face (324), and said contact spring (320), adjacent at least one of its axial end portions, being three-dimensionally curved in the shape of a bath-tub (at 320*g*) over at least a portion of its length, the bath-tub configuration having longitudinal edge zones (320*f*) substantially parallel to said longitudinal axis, said longitudinal edge zones (320*f*) engaging the respective lateral face (324) substantially over the entire length of said edge zones (320*f*) when said contact pin unit has been introduced into engagement with said internal surface (318) of said plug socket.

79. A contact pin unit as claimed in claim 78, wherein the contact spring (320) is provided, at at least one end, with an end flange (320*h*) which continues the bath-tub configuration (320*g*) in the axial direction, and in that this end flange (320*h*) abuts the respective lateral face (324) perpendicular to the short cross-sectional axis (Y).

80. A contact pin unit as claimed in claim 79, wherein the end flange (320*h*) is fastened to said basic pin by one of the soldering or welding methods.

81. A contact pin unit as claimed in claim 79, wherein the end flange (320*h*) has a convexly curved, axially directed terminal edge.

82. A contact pin unit as claimed in claim 81, wherein said convexly curved terminal edge is located such as to be introduced first into said plug socket when said contact pin (310) is introduced into said plug socket.

83. A contact pin unit as claimed in claim 78, wherein said bath tub configuration has an apex line substantially parallel to the respective lateral face (324).

84. A contact pin unit as claimed in claim 78, wherein said bath tub configuration has a curved edge zone at at least one axial end portion thereof, said curved edge zone contacting the respective lateral face (324).

85. A contact pin unit as claimed in claim 78, wherein said bath tub configuration has, when regarded in a section perpendicular to said longitudinal axis, a radially outer convex side (320*b*) directed towards said internal surface (318) and having at least in a zone adjacent an apex thereof a radius of curvature smaller than the radius of curvature of said internal surface (318).

86. A contact pin unit as claimed in claim 78, wherein said bath tub configuration defines, when regarded in a section perpendicular to said longitudinal axis and located at an axially intermediate location between said axial end portions, a curve, said curve having an apex zone, said curve having a predetermined radius of curvature in said apex zone in the untensioned state, i.e. before inserting said contact pin unit into said plug socket, said predetermined radius of curvature being increased by said radial pressure, i.e. when said contact pin unit is introduced into said plug socket.

87. A contact pin unit as claimed in claim 78, wherein the lateral faces (324,326) of the partial section (A) merge in a substantially continuous manner with corresponding lateral faces of the basic pin (310).

88. A small-sized electrical contact pin unit for engagement with an internal surface (18) of a plug socket (14) capable of being provided in a device such as a printed circuit board, said internal surface (18) having an approximately circular cross-sectional area, said contact pin unit comprising an elongate basic pin (10) having a longitudinal axis and elongated opposite ends, a partial section (A) being elongate over at least part of the axial length of the basic pin (10) between said elongated opposite ends, said partial section (A) having lateral faces (24, 26), said partial section (A) having a long cross-sectional axis (X), whose length corresponds approximately to the inside diameter of said internal surface (18) so as to provide centering of the basic pin (10) in the plug socket 14, and a short cross-sectional axis (Y), at least one (24) of said lateral faces (24, 26) being substantially plane and substantially perpendicular to the short cross-sectional axis (Y) within said partial section of said basic pin (10), a contact spring (20) elongate in said axial direction, said contact spring being laterally supported on said one lateral face (24) in a direction perpendicular to the longitudinal axis of the basic pin (10) without extending over either of the elongated opposite ends of said basic pin and being conductively connected to said basic pin, said contact spring (20) being dimensioned such as to make electric contact with said internal surface (18) of said plug socket (14) with radial pressure substantially perpendicular with respect to said one lateral face (24), said contact spring (20) being formed of sheet metal and, considered in a cross-section that is perpendicular to the longitudinal axis of the basic pin (10), said contact spring (20) being curved and having a substantially concave internal side (20*a*), which is directed towards the basic pin (10), and a substantially convex external side (20*b*) which is directed towards the internal surface (18) of the plug socket (14) when the contact pin unit is mounted in the socket, said contact spring (20) also having longitudinal edge zones (20*f*) with sharp edges (20*ff*) substantially parallel to said longitudinal axis, said sharp edges (20*ff*) being engageable with said one lateral face (24).

89. A contact pin unit as claimed in claim 88, wherein, considered in said cros-section perpendicular to the longitudinal axis of the the basic pin, the external side (20*b*) has a radius of curvature which is slightly smaller than or, at the most, equal to the inside radius of the internal surface (18) of the plug socket (14).

90. A contact pin unit as claimed in claim 88, wherein the contact spring (20) extends in an arc-shaped manner along said longitudinal axis of said basic pin (10), with a concave arc curvature that is directed towards said one lateral face (24) and a convex arc curvature that is directed towards the internal surface (18) of the plug socket (14) when the contact pin is mounted in the socket.

91. A contact pin unit as claimed in claim 90, wherein, at least after the contact pin unit has been inserted into said plug socket (14), two axially spaced end portions of said contact spring (20) are supported on said one lateral face (24) of said basic pin (10).

92. A contact pin unit as claimed in claim 90, wherein the contact spring (20) is fastened to the basic pin (10) with a first end and abuts the partial section (A) of the basic pin (10) with its second end (20*a*) so as to be displaceable in the longitudinal direction of the latter.

93. A contact pin unit as claimed in claim 92, wherein, at its second end (20*a*), the contact spring (20) is opposite to a stop (34) which limits its displaceability in the longitudinal direction of the basic pin (10).

94. A contact pin unit as claimed in claim 93, wherein the stop (34) has been co-ordinated with the length of the contact spring and with the inside diameter of the plug socket (14) in such a way that the second end (20*a*) butts thereagainst before the contact spring (20) enters the plug socket (14).

95. A contact pin unit as claimed in claim 88, wherein the contact spring (20) has at least one axial end portion welded or soldered to the basic pin (10).

96. A contact pin unit as claimed in claim 97, wherein each of two radially opposite lateral faces (24) perpendicular to the short cross-sectional axis (Y) are each provided with a contact spring (20), said contact springs (20) being made from sheet metal.

97. A contact pin unit as claimed in claim 96, wherein a connection part (28) is U-shaped and has a web (28*a*), which abuts a basic pin (10) lateral surface zone (30*a*) that is perpendicular to the long cross-sectional axis (X) of the partial section (A), and two legs (28*b*) which abut the partial section (A) lateral surfaces (24) that are perpendicular to the short cross-sectional axis (Y) of the partial section (A), and in that the contact springs (20) extend from respective legs (28*b*).

98. A contact pin unit as claimed in claim 97, wherein the web (28*a*) abuts a basic pin (10) lateral surface zone (30*a*) that is perpendicular to the long cross-sectional axis (X) of the partial section (A) and which is set back, in relation to the associated partial section (A) lateral surface (26) that is defined by the long cross-sectional axis (X), towards the basic pin axis.

99. A contact pin unit as claimed in claim 97, wherein the web (28*a*) and/or at least one of the legs (28*b*) have been soldered or welded together with the basic pin (10) lateral surface zone which respectively butts thereagainst.

100. A contact pin unit as claimed in claim 97, wherein the lateral faces (26, 326) substantially perpendicular to said long cross-sectional axis (X) of said partial section (A) are convexly rounded towards the internal surface (18, 318) of the plug socket (14).

101. A contact pin unit as claimed in claim 88, wherein the lateral faces (126, 326) perpendicular to said long cross-sectional axis (X) of said partial section (A) converge towards each other at at least one end of said partial section (A); said one end being intended for being introduced first into said plug socket (14).

102. A contact pin unit as claimed in claim 88, wherein said partial section A has been formed by flattening a piece of wire forming the basic pin (10, 310).

103. A contact pin unit as claimed in claim 102, wherein the piece of wire (10, 310) has a square cross-sectional area with two transverse intersecting central axes, and wherein said axes (X,Y) of said flattened partial section (A) are parallel to said transverse intersecting central axes.

104. A contact pin unit as claimed in claim 102, wherein a stop (34) for the contact spring (20) is formed by the transition shoulder from the flattened partial section (A) to an adjoining undeformed wire section (C), there being, if necessary, integrally formed with this transition shoulder (34) a holding nose (36) which engages over the contact spring, at least after it has reached the stop (34).

105. A contact pin unit as claimed in claim 102, wherein the partial section (A) has, at at least one end, a flattened transition section (D), whose short cross-sectional axis corresponds in its length to the short cross-sectional axis (Y) of the flattened partial section (A) and whose long axis corresponds to the corresponding axis of the undeformed piece of wire or is smaller than this axis, and in that the connection part (28) abuts this transition section (D).

106. A contact pin unit as claimed in claim 102, wherein the legs (28*b*) of the connection part (28) abut, with their edges (28*c*) that are remote from the contact springs (20), transition shoulders (32) between the flattened partial section (A) and an adjoining section (B) of the undeformed piece of wire (10).

107. A contact pin unit as claimed in claim 88, wherein the inside diameter of said internal surface (18, 318) of said plug socket (14) is smaller than 2.5 mm, more especially approximately 1 mm.

108. A contact pin unit as claimed in claim 88, wherein the ratio of the length of the long axis (X) of said partial section (A) to the length of the short axis (Y) of said partial section (A) is in a range of 1.5:1 to 4:1, preferably approximately 2:1 to 3:1.

109. A contact pin unit as claimed in claim 88, wherein the thickness of the sheet metal is approximately 5/100 to approximately 20/100 mm.

110. A contact pin unit as claimed in claim 88, wherein the ratio of the axial length of the partial section (A) to the inside diameter of the internal surface (18, 318) of the plug socket is about 2:1 to about 4:1, preferably approximately 3:1.

111. A contact pin unit as claimed in claim 88, wherein the plug socket is formed by a hole the internal surface of which has been metalized, more especially a tin-coated hole (18) in a printed-circuit board (16).

112. A contact pin unit as claimed in claim 88, wherein the contact spring (220, 320) has a rounded or pointed contour adjacent at least one of its ends, said at least one end being introduced first when said contact pin unit is introduced into said plug socket (14).

113. A method for the production of a contact pin package as claimed in claim 88, wherein two contact springs (220) with a U-shaped connection piece (228) are placed, transversely to the longitudinal axis of the basic pin, on this pin and may be welded thereto.

114. A contact pin unit as claimed in claim 88, wherein the one lateral face (24) is substantially roof-shaped and substantially perpendicular to the short cross-sectional axis (Y).

115. A contact pin unit as claimed in claim 88, wherein the one lateral face (24) is substantially trough-shaped and substantially perpendicular to the short cross-sectional axis.

116. A contact pin unit as recited in claim 78, wherein each of two radially opposite lateral faces (324) perpendicular to the short cross-sectional axis (Y) are each provided with a contact spring (320) being made of sheet metal.

* * * * *